US006326942B1

(12) United States Patent
Akimoto

(10) Patent No.: US 6,326,942 B1
(45) **Date of Patent: *Dec. 4, 2001**

(54) OPTICAL SPATIAL MODULATION DEVICE AND IMAGE DISPLAY APPARATUS

(75) Inventor: Osamu Akimoto, Tokyo (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,753

(22) Filed: Jun. 23, 1998

(30) Foreign Application Priority Data

Jun. 25, 1997 (JP) ..... 9-169195
Apr. 7, 1998 (JP) ..... 10-094877

(51) Int. Cl.[7] ..... G09G 3/36
(52) U.S. Cl. ..... 345/98; 345/87; 345/99
(58) Field of Search ..... 345/98, 99, 100, 345/87, 88, 89, 90, 91, 92, 93, 94, 204, 208, 211

(56) References Cited

U.S. PATENT DOCUMENTS 4,909,602 * 3/1990 Kaneko et al. ..... 345/92
5,111,195 * 5/1992 Fukuoka et al. ..... 345/94
5,483,255 * 1/1996 Numao ..... 345/98
5,627,557 * 5/1997 Yamaguchi et al. ..... 345/90
5,875,006 * 2/1999 Nagae et al. ..... 348/751
6,181,311 * 1/2001 Hashimoto ..... 345/102

OTHER PUBLICATIONS

Yoko Watanabe, "New Technology Seen from Patent Information: 13 Liquid Crystal," from the Jul. 1995 issue of the Japanese magazine "Inventions," vol. 92, pp. 26–31. English language translation.
Takashi Hinatsu, "New Technology Seen from Patent Information: 26 Liquid Crystal Display Device," from the Aug. 1996 issue of the Japanese magazine "Inventions," vol. 93, pp. 62–69. English language translation.

* cited by examiner

*Primary Examiner*—Xiao Wu
(74) *Attorney, Agent, or Firm*—Ronald P. Kananen; Rader, Fishman & Grauer

(57) ABSTRACT

To provide an optical spatial modulation device capable of rewriting an image with a high degree of efficiency and implementing a very fast response speed and an extremely high intensity, and to provide an image display apparatus employing the optical spatial modulation device. Created for each pixel of an optical spatial modulation device are a $1^{st}$ memory for storing pixel data of an image to be displayed, a $2^{nd}$ memory to which the pixel data stored in the $1^{st}$ memory is transferred and a driving means driven in accordance with the pixel data transferred to the $2^{nd}$ memory to change the optical transmissivity, the optical reflectance or the polarization state of the pixel. When displaying an image, first of all, pixel data is stored in the $1^{st}$ memory of each of all pixels composing the image. Then, the pixel data is transferred from the $1^{st}$ memory to the $2^{nd}$ memory. Finally, the driving means of each of the pixels changes the optical transmissivity, the optical reflectance or the polarization state of the pixel in accordance with the pixel data transferred to the $2^{nd}$ memory.

11 Claims, 21 Drawing Sheets

| FIG. 8A |
| --- |
| FIG. 8B |

| FIG. 12A | |
|---|---|
| | FIG. 12B |

| FIG. 16A | FIG. 16B |
|---|---|

| FIG.20A |
| --- |
| FIG.20B |

| FIG.24A |
| --- |
| FIG.24B |

OPTICAL SPATIAL MODULATION DEVICE AND IMAGE DISPLAY APPARATUS

BACKGROUND OF THE INVENTION

The present invention relates to an optical spatial modulation device for modulating radiated light in accordance with information representing an image to be displayed for each pixel and an image display apparatus employing the optical spatial modulation device.

A liquid crystal display device is known as an optical spatial modulation device for modulating radiated light in accordance with information representing an image to be displayed for each pixel. There has been widely used a ordinary liquid crystal display device of a type wherein the intensity of light is modulated by putting an array of so-called twisted nematic liquid crystals, that is, liquid crystals used in a twisted nematic operating mode, in continuously varying states. A twisted nematic liquid crystal is referred to hereafter simply as a TN liquid crystal.

With regard to such liquid crystal materials and liquid crystal display devices, there have been published an article with a title "New Technology Seen from Patent Information: 13 Liquid Crystal," authored by Yoko Watanabe, Pages 26 to 31, Volume 92, a July 1995 issue of "Inventions", a monthly magazine published by Japan Institute of Invention and Innovation, an article with a title "New Technology Seen from Patent Information: 26 Liquid Crystal Display Device," authored by Takashi Hinatsu, Pages 62 to 69, Volume 92, an August 1996 issue of "Inventions", a monthly magazine published by Japan Institute of Invention and Innovation and a book with a title "Liquid Crystal Device Handbook," issued by the 142$^{nd}$ Committee of the Japan Society for the Promotion of Science and published by the Nikkan Kogyo Newspaper.

However, the TN liquid crystal has a problem of a slow response speed, making it desirable to develop an optical spatial modulation device that is capable of operating at a high speed. As a liquid crystal material for light modulation that is capable of operating at a high speed, for example, there are a ferroelectric liquid crystal referred to hereafter as an FLC and a non-ferroelectric inductive liquid crystal. An FLC has a state storing characteristic. In general, as a state, there may be only 2 values. Thus, with an optical spatial modulation device using such a material for light modulation, continuous light modulation can not be carried out. That is to say, such a device is capable of operating by merely changing from an on state to an off state or vice versa.

In addition, as a liquid crystal material for light modulation having a state storing characteristic, there are also a cholesteric liquid crystal or a kailar nematic liquid crystal operating in a phase transition mode and a polymer liquid crystal which carries out write and erase operations between isotropic and glass phases. Other liquid crystal materials that can be used as a material for light modulation include a polymer diffusion liquid crystal which is referred to hereafter as a PDLC.

When displaying a multi-tone image by means of an optical spatial modulation device using such a material for light modulation, a pulse width modulation (PWM) technique is typically adopted in order to make use an afterglow characteristic of the human eye. To put it in detail, when displaying a multi-tone image by means of such an optical spatial modulation device, light is switched from an on state to an off state and vice versa at a high speed with controlled timing so that the multi-tone image is displayed and projected on a human eye.

The following is a description of an image display apparatus employing such an optical spatial modulation device.

FIG. 22 is a conceptual diagram showing the image display apparatus. As shown in the figure, a light generated by a light source 101 is radiated to an optical spatial modulation device 103 by a radiation optical system 102. The light modulated by the optical spatial modulation device 103 is then projected on a screen 105 by a projection optical system 104. As a result, an image is displayed on the screen 105.

FIG. 23 is a diagram showing a squint view of disassembled components of an enlarged portion of the optical spatial modulation device 103 mentioned above. As shown in the figure, the optical spatial modulation device 103 comprises a driving layer 106, a reflection layer 107, a modulation layer 108 and a common electrode 109. It should be noted that, if the modulation layer 108 is implemented by a crystal, an orientation layer is provided between the common electrode 109 and the crystal and another orientation layer is provided between the crystal and the reflection layer 107.

In an operation to drive this optical spatial modulation device 103, first of all, data coming from a data line 111 is written into each memory cell 112 at a point of intersection of a scanning line 110 and the data line 111 created on the driving layer 106. Each of the memory cells 112 corresponds to a pixel.

Next, electric fields are applied to the electrically charged modulation layer 108 provided between reflection pads 113 created on the reflection layer 107 and the common electrode 109 in accordance with pieces of data recorded in the memory cells 112 so as to reflect the respective pixels. The modulation layer is implemented typically by an FLC. As a result, areas of the modulation layer 108 are put in either a light passing state or a light shielding state in dependence on pixels facing the areas.

Then, some of the light radiated to the optical spatial modulation device 103 passing through the modulation layer 108 is reflected by the reflection pads 113 on the reflection layer 107 and output by way of the reflection layer 108 as shown in FIG. 22. That is to say, only some of the light radiated to the optical spatial modulation device 103 that manages to pass through the modulation layer 108 is reflected. As a result, light is modulated for each pixel.

In order to continuously change a displayed image in this image display apparatus, the radiation of a light from the light source 101 is halted each time the image is changed and then the state of the modulation layer 108 is changed with respect to all the pixels. Then, at a point of time the operation to change the state of the modulation layer 108 with respect to all the pixels is completed, the radiation of the light from the light source 101 is resumed. As a result, lights modulated for the pixels are sequentially projected on the screen 105. Thus, while the state of the modulation layer 108 of the optical spatial modulation device 103 employed in the image display apparatus is being changed, the light source 101 is turned off. As the operation to change the state of the modulation layer 108 is completed, a light is radiated from the light source 101 to the optical spatial modulation device 103.

It should be noted that, since the FLC normally has a state storing characteristic, once an electric field is applied to put the FLC in a desired state, residual electric charge remains in the FLC. It is thus necessary to apply an electric field to the FLC in the opposite direction in order to neutralize the residual electric charge. As a technique for neutralizing residual electric charge, among other methods, a 2-field technique is known. In the 2-field technique, pieces of pixel data of a desired image are written into the memory cells 112 in order to apply electric fields to the modulation layer 108 in accordance with the pieces of pixel data to display the desired image. Then, pieces of pixel data for inverting the pieces of pixel data of the displayed image are written into the memory cells 112 in order to apply electric fields to the modulation layer 108 in accordance with the pieces of pixel data newly written into the memory cells 112. That is to say, according to this 2-field technique, residual electric charge is neutralized by alternately applying electric fields to the modulation layer 108 in opposite directions for a display of 1 picture.

The image display apparatus like the one described above is further explained by referring to timing charts shown in FIG. 24. In the example shown in the figure, the 2-field technique is adopted. In this case, the number of scanning lines 110 is n.

As shown in FIG. 24, a period of time required for displaying 1 screen comprises an uninverted data write period and an inverted data write period. During the uninverted data write period, pieces of pixel data of a desired image are written into the memory cells 112 in order to apply electric fields to the modulation layer 108 in accordance with the pieces of pixel data to display the desired image. During the inverted data write period, on the other hand, pieces of pixel data for neutralizing the pieces of pixel data of the displayed image are written into the memory cells 112 in order to apply electric fields to the modulation layer 108 in a direction opposite to the electric fields applied during the uninverted data write period.

The uninverted data write period comprises a data write period and a light emit period. During the data write period, pixel data of an image to be displayed is written into memory cells 112 in order to put the modulation layer 108 in a predetermined state corresponding to the image to be displayed. During the light emit period, on the other hand, a light is radiated from the light source 101 to the optical spatial modulation device 103 wherein the modulation layer 108 is put in a predetermined state corresponding to the image to be displayed. That is to say, only during the light emit period is the image actually displayed.

On the other hand, the inverted data write period comprises an inverted data write period and a light emit equivalent period. During the inverted data write period, pixel data for inverting the pixel data of the image displayed during the light emit period is written into memory cells 112 in order to put the modulation layer 108 in an inverted state. The light emit equivalent period is a period required to make the length of the inverted data write period equal to the length of the uninverted data write period so that residual electric charge is completely neutralized. During the light emit equivalent period which is a counterpart of the light emit period, the modulation layer 108 is held in an inverted state.

During the data write period, pixel data generated along the scanning lines 110 is supplied to the data lines 111 and written into the memory cells 112.

To put it in detail, first of all, pixel data D1 is supplied to the data lines 111 and, at the same time, a write signal is supplied to the $1^{st}$ scanning line 110 during the data write period. Thus, the pixel data D1 is written into the memory cells 112 connected to the $1^{st}$ scanning line. It should be noted that the pixel data D1 is part of pixel data of an image to be displayed, that is, pieces of data for pixels corresponding to the memory cells 112 connected to the $1^{st}$ scanning line. Then, areas of the modulation layer 108 facing the memory cells 112 on the $1^{st}$ scanning line which correspond to the pixels are put in a light passing state or a light shielding state in dependence on the pixel data D1. That is to say, the states of pixels corresponding to the memory cells 112 connected to the $1^{st}$ scanning line are set depending on the pixel data D1.

Then, pixel data D2 is supplied to the data lines 111 and, at the same time, a write signal is supplied to the $2^{nd}$ scanning line 110. Thus, the pixel data D2 is written into the memory cells 112 connected to the $2^{nd}$ scanning line. It should be noted that the pixel data D2 is part of pixel data of an image to be displayed, that is, pieces of data for pixels corresponding to the memory cells 112 connected to the $2^{nd}$ scanning line. Then, areas of the modulation layer 108 facing the memory cells 112 on the $2^{nd}$ scanning line which correspond to the pixels are put in a light passing state or a light shielding state in dependence on the pixel data D2. That is to say, the states of pixels corresponding to the memory cells 112 connected to the $2^{nd}$ scanning line are set depending on the pixel data D2.

Thereafter, pixel data is written into the memory cells 112 connected to subsequent scanning lines and the states of pixels corresponding to the memory cells 112 connected to the scanning lines are set depending on the pixel data in the same way. Finally, pixel data Dn is supplied to the data lines 111 and, at the same time, a write signal is supplied to the $n^{th}$ scanning line 110. Thus, the pixel data Dn is written into the memory cells 112 connected to the $n^{th}$ scanning line. It should be noted that the pixel data Dn is part of pixel data of an image to be displayed, that is, pieces of data for pixels corresponding to the memory cells 112 connected to the $n^{th}$ scanning line. Then, areas of the modulation layer 108 facing the memory cells 112 on the $n^{th}$ scanning line which correspond to the pixels are put in a light passing state or a light shielding state in dependence on the pixel data Dn. That is to say, the states of pixels corresponding to the memory cells 112 connected to the $n^{th}$ scanning line are set depending on the pixel data Dn.

As described above, all the pixels are set in states reflecting the image to be displayed during the data write period. It should be noted that, during the data write period, the light source 101 is turned off in order to avoid a disorder state of a light reflected in a state transition of the modulation layer 108.

By the same token, first of all, pixel data D1' is supplied to the data lines 111 and, at the same time, a write signal is supplied to the $1^{st}$ scanning line 110 during the inverted data write period. Thus, the pixel data D1' is written into the memory cells 112 connected to the $1^{st}$ scanning line. It should be noted that the pixel data D1' is part of pixel data of an image to be displayed, that is, pieces of data for pixels corresponding to the memory cells 112 connected to the $1^{st}$ scanning line. Then, the states of areas of the modulation layer 108 facing the memory cells 112 on the $1^{st}$ scanning line which correspond to the pixels are inverted in dependence on the pixel data D1'.

Then, pixel data D2' is supplied to the data lines 111 and, at the same time, a write signal is supplied to the $2^{nd}$ scanning line 110. Thus, the pixel data D2' is written into the memory cells 112 connected to the $2^{nd}$ scanning line. It should be noted that the pixel data D2' is part of pixel data of an image to be displayed, that is, pieces of data for pixels corresponding to the memory cells 112 connected to the $2^{nd}$ scanning line. Then, the states of areas of the modulation layer 108 facing the memory cells 112 on the $2^{nd}$ scanning line which correspond to the pixels are inverted in dependence on the pixel data D2'.

Thereafter, pixel data is written into the memory cells 112 connected to subsequent scanning lines and the states of pixels corresponding to the memory cells 112 connected to the scanning lines are set depending on the pixel data in the same way. Finally, pixel data Dn' is supplied to the data lines 111 and, at the same time, a write signal is supplied to the $n^{th}$ scanning line 110. Thus, the pixel data Dn' is written into the memory cells 112 connected to the $n^{th}$ scanning line. It should be noted that the pixel data Dn' is part of pixel data of an image to be displayed, that is, pieces of data for pixels corresponding to the memory cells 112 connected to the $n^{th}$ scanning line. Then, the states of areas of the modulation layer 108 facing the memory cells 112 on the $n^{th}$ scanning line which correspond to the pixels are put in a light passing state or a light shielding state in dependence on the pixel data Dn'.

As described above, the states of all the pixels are inverted during the inverted data write period. It should be noted that, during the data write period and the light emit equivalent period, the light source 101 is turned off.

As indicated by the timing charts shown in FIG. 24, in the ordinary liquid crystal display device, data stored in memory cells of each scanning line is rewritten and then, after data of all memory cells has been rewritten, light is radiated from a light source. Thus, in the case of a liquid crystal display device with a large number of scanning lines, the time allocated to emission of light is shortened and, as a result, a high intensity can not be obtained anymore.

In addition, even if an FLC having a response speed faster than a TN liquid crystal is used, the response speed of its optical spatial modulation device is not sufficient, making it desirable to further increase the response speed.

On the top of that, when a light modulation material that needs neutralization of residual electric charge is used, it is necessary to write inverted data after displaying an image as described above in order to neutralize electric charge injected into a modulation layer, or to supply a pulse voltage for neutralizing electric charge. However, a period for neutralizing electric charge does not contribute to the display of an image. As a result, such neutralization period causes saturation of the response speed and deterioration of the intensity. In the case of neutralization of electric charge by using the 2-field technique as shown in FIG. 24, for example, it is necessary to provide an inverted data write period in addition to the uninverted data write period. As a result, the frame rate is reduced by half, making the efficiency poorer.

SUMMARY OF THE INVENTION

The present invention is proposed to address the problems described above. It is thus an object of the present invention to provide an optical spatial modulation device which is capable of rewriting a displayed image with a high degree of efficiency and implementing a very fast response speed and an extremely high intensity, and to provide an image display apparatus employing the optical spatial modulation device.

Provided with a plurality of pixels composing an image to be displayed, the optical spatial modulation device provided by the present invention modulates radiated light for each of the pixels in accordance with pixel data of the image. For each of the pixels, the optical spatial modulation device comprises:

- a $1^{st}$ memory for storing pixel data of an image to be displayed;
- a $2^{nd}$ memory to which pixel data stored in the $1^{st}$ memory is transferred; and
- a driving means for carrying out a driving operation in accordance with pixel data transferred to the $2^{nd}$ memory in order to change the state of the pixel.

In an operation to display an image, first of all, pixel data is written into the $1^{st}$ memory for each of the pixels composing the image. Then, the pixel data written into the $1^{st}$ memory is transferred to the $2^{nd}$ memory. Finally, the state of each pixel is changed by the driving means in accordance with the pixel data transferred to the $2^{nd}$ memory.

On the other hand, the image display apparatus provided by the present invention comprises a light source for radiating light and the optical spatial modulation device. Provided with a plurality of pixels composing an image to be displayed, the optical spatial modulation device modulates the light radiated by the light source for each of the pixels in accordance with pixel data of the image. For each of the pixels, the optical spatial modulation device comprises:

- a $1^{st}$ memory for storing pixel data of an image to be displayed;
- a $2^{nd}$ memory to which pixel data stored in the $1^{st}$ memory is transferred; and
- a driving means for carrying out a driving operation in accordance with pixel data transferred to the $2^{nd}$ memory in order to change the state of the pixel.

In an operation to display an image, first of all, pixel data is written into the $1^{st}$ memory for each of the pixels composing the image. Then, the pixel data written into the $1^{st}$ memory is transferred to the $2^{nd}$ memory. Finally, the transmissivity and the reflectance of each pixel are changed by the driving means in accordance with the pixel data transferred to the $2^{nd}$ memory.

BRIEF DESCRIPTION OF THE DRAWINGS

Preferred embodiments of the present invention will be described by referring to the following diagrams wherein.

DETAILED DESCRIPTION OF THE PREFERRED EMBODIMENTS

The present invention will become more apparent from a careful study of the following detailed description of some preferred embodiments with reference to the accompanying diagrams.

Configuration of the Image Display Apparatus

The description begins with simple and plain explanation of a configuration of a typical image display apparatus provided by the present invention.

Figure 1:
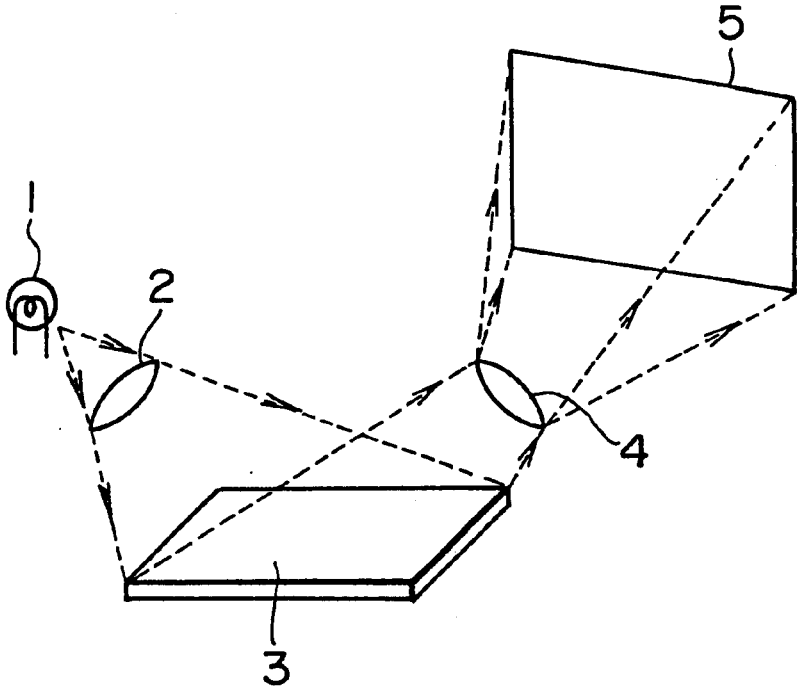
FIG. 1 is a conceptual diagram showing the configuration of a typical image display apparatus provided by the present invention in a simple and plain manner.

FIG. 1 is a conceptual diagram showing the image display apparatus which comprises a light source 1, a radiation optical system 2, an optical spatial modulation device 3, a projection optical system 4 and a screen 5.

The light source 1 can be turned on and off at a high speed and, as will be described later, the light source 1 is turned on during a light emit period an turned off during other periods. It should be noted that a color image can be displayed by means of a light source used as a light source 1 that is capable of emitting red light, green light and blue light corresponding to the 3 elementary colors of light. To put it concretely, 3 independent light sources can be used for emitting red light, green light and blue light respectively corresponding to the 3 elementary colors of light. As an alternative, a dichroic mirror can be used for splitting light radiated by a single light source into red light, green light and blue light.

The radiation optical system 2 is an optical system used for radiating a light coming from the light source 1 to the optical spatial modulation device 3. That is to say, a light generated by the light source 1 is radiated to the optical spatial modulation device 3 by way of the radiation optical system 2.

The optical spatial modulation device 3 is the optical spatial modulation device provided by the present invention. Its details will be described later. It should be noted that the optical spatial modulation device 3 is an optical spatial modulation device of a reflection type wherein a light generated by the light source 1 is modulated and then reflected for each of a number of pixels composing an image. Such a reflective optical spatial modulation device 3 comprises elements such as memories to be described later. Since the elements are provided on a side opposite to a surface that reflects light, the area of the effective aperture of each pixel is no longer narrowed by the existence of the elements. That is to say, in the case of such a reflective optical spatial modulation device 3, the area of the effective aperture of each pixel can be enlarged.

It should be noted, however, that it is also possible to use an optical spatial modulation device 3 of a transmission type wherein a light generated by the light source 1 is modulated and then passed through. When a transmissive optical spatial modulation device is used as the optical spatial modulation device 3, a backlight is typically provided on the back surface of the optical spatial modulation device 3. A light emitted by the backlight and passing through the optical spatial modulation device 3 displays an image. By using a transmissive optical spatial modulation device, the image display apparatus can be made very thin.

The projection optical system 4 is an optical system for projecting a light modulated and reflected by the optical spatial modulation device 3 on the screen 5. A light emitted by the light source 1 and then reflected by the optical spatial modulation device 3 is projected on the screen 5 by the projection optical system 4. That is to say, in this image display apparatus, an image obtained by modulation of a light generated by the light source 1 by means of the optical spatial modulation device 3 is displayed on the screen 5.

As described above, in this image display apparatus, a light generated by the light source 1 is radiated by the radiation optical system 2 to the optical spatial modulation device 3 and a light modulated and reflected by the optical spatial modulation device 3 is projected by the projection optical system 4 on the screen 5. As a result, an image is displayed on the screen 5.

When displaying an image in this image display apparatus, the light source 1 is turned on and off at a high speed and, at the same time, the optical spatial modulation device 3 is driven synchronously with the blinking of the light source 1. To put it in detail, when an image displayed in this image display apparatus is changed, pixels of the optical spatial modulation device 3 are rewritten while the light source 1 is in an off state. At a point of time the operation to rewrite all pixels have is completed, the light source 1 is turned on. In this way, images created by light modulated for each of the images are displayed sequentially on the screen 5.

It should be noted that, if the time required for rewriting the pixels of the optical spatial modulation device 3 is short enough to make the visual sense of the watcher unaware of the rewriting process, it is not necessary to turn off the light source 1.

Configuration of the Optical Spatial Modulation Device

The following is a description of the optical spatial modulation device 3 employed in the image display apparatus described above.

Figure 2:
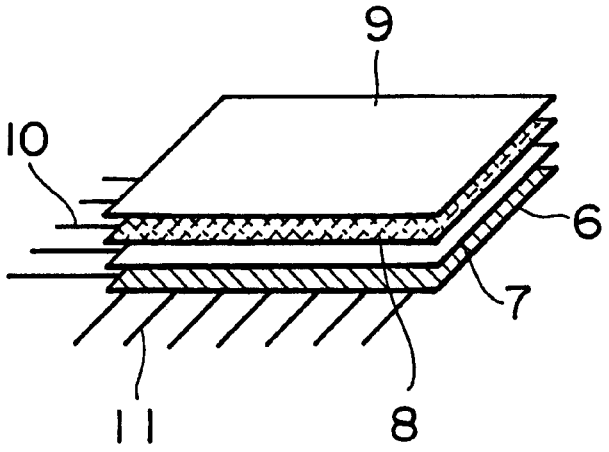
FIG. 2 is a diagram showing a squint view of a model representing the configuration of a typical optical spatial modulation device provided by the present invention in a simple and plain manner.
Figure 3:
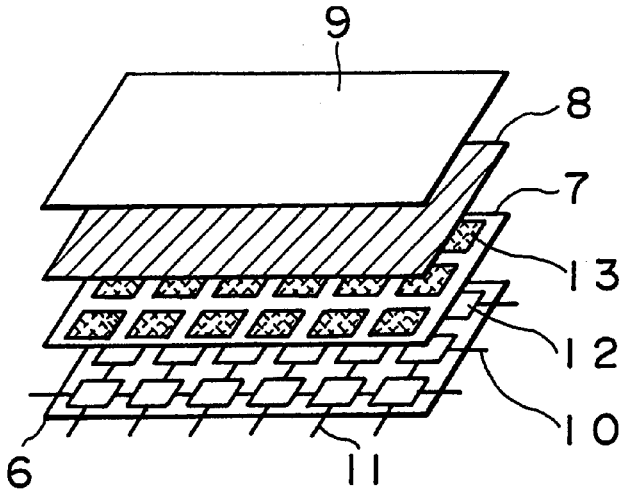
FIG. 3 is a diagram showing a squint view of a model representing a configuration of disassembled components of an enlarged portion of the optical spatial modulation device shown in FIG. 2 in a simple and plain manner.
Figure 4:
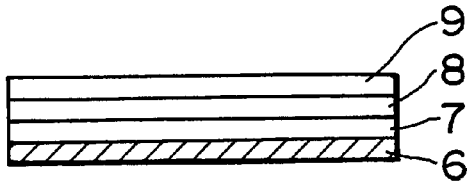
FIG. 4 is a cross-sectional diagram showing a model representing a stacked layer structure of the optical spatial modulation device shown in FIG. 2 in a simple and plain manner.

FIG. 2 is a diagram showing a squint view of a model of the optical spatial modulation device 3 in a simple and plain manner. FIG. 3 is a diagram showing a squint view of a model representing disassembled components of an enlarged portion of the optical spatial modulation device 3 in a simple and plain manner. FIG. 4 is a cross-sectional diagram showing a model representing a stacked layer structure of the optical spatial modulation device 3.

The optical spatial modulation device 3 comprises a plurality of pixels each having a controllable optical reflectance. Light radiated to the optical spatial modulation device 3 is modulated and reflected for each of the pixels in accordance with information on an image to be displayed. As shown in FIGS. 2 to 4, the optical spatial modulation device 3 comprises a driving layer 6, a reflection layer 7 above the driving layer 6, a modulation layer 8 above the reflection layer 7 and a common electrode 9 above the modulation layer 8.

The driving layer 6 comprises driving devices created thereon for changing the states of the pixels in accordance with an image to be displayed. On the driving layer 6, a plurality of scanning lines 10 and a plurality of data lines 11 are created and a memory cell 12 is formed at each point of intersection of the scanning lines 10 and the data lines 11 as shown in FIGS. 2 and 3. Each of the memory cells 12 corresponds to a pixel. In this optical spatial modulation device 3, an electric field can be applied to the modulation layer 8 for each of the pixels, that is, for each of the memory cells 12 created on the driving layer 6. It should be noted that, on the driving layer 6, control lines to be described later are created in addition to the scanning lines 10 and the data lines 11. However, the control lines are not shown in FIGS. 2 and 3.

Made of a light reflecting material having a high reflectance such as aluminum, the reflection layer 7 is a layer for reflecting light coming from the light source 1. It should be noted that the reflection layer 7 is provided so that light coming from the light source 1 is reflected thereby. For example, the reflection layer 7 can comprise light reflecting reflection pads 13 each provided for a pixel as shown in FIG. 3. As an alternative, the reflection layer 7 can be designed so that light is reflected uniformly over the entire area of the optical spatial modulation device 3. In the case of a reflection layer 7 comprising light reflecting reflection pads 13 each provided for a pixel, a light is reflected by the reflection layer 7 for each pixel so that interference among pixels-can be avoided. In the case of a reflection layer 7 designed so as to reflect light uniformly over the entire area of the optical spatial modulation device 3, on the other hand, a high intensity can be obtained because light coming from the light source 1 is reflected over the entire area.

Used for modulating a light coming from the light source 1, the modulation layer 8 is made of a material for light modulation such as an FLC, PDLC or TN liquid crystal which fills up a gap between the reflection layer 7 and the common electrode 9. The modulation layer 8 is capable of controlling the optical transmissivity in accordance with an electric field applied between the driving layer 6 and the common electrode 9 for each pixel. That is to say, by controlling electric fields applied to the modulation layer 8, the quantity of light passing through the modulation layer 8 can be controlled. It should be noted that, in the case of a modulation layer 8 made of a material requiring orientation such as a crystal, an orientation layer for orientating the material needs to be provided inside or in close proximity to the modulation layer 8.

In this case, a layer that can be put in either of 2 states depending on the intensity of a magnetic field applied thereto is used as the modulation layer 8. The 2 states are a state with a high optical transmissivity and a state with a low optical transmissivity. Thus, the modulation layer 8 allows each pixel to undergo 2-value optical modulation. A state which the modulation layer 8 has initially is referred to as an initial state. The initial state can be either of the 2 states. A state exhibiting an optical transmissivity different from that of the initial state is referred to a driven state. In the case of a modulation layer 8 made of an FLC, for example, the initial state of a pixel is a state in which no electric charge is injected into a portion of the a modulation layer 8 corresponding to the pixel. On the other hand, the driven state of a pixel is a state in which electric charge is injected into a portion of the modulation layer 8 corresponding to the pixel.

As described above, in the present embodiment, the modulation layer 8 can be put only in 2 states. It should be noted, however, that a modulation layer that can be put in 3 or more states can also be used. In such a case, the modulation layer can be put in any one of a plurality of driven states.

In addition, in the embodiment described above, by changing the optical transmissivity of the modulation layer 8 itself, the quantity of light of each pixel can be controlled. It is worth noting, however, that by making the modulation layer 8 of a material allowing the polarization state of a passing light to change and combining such a modulation layer 8 with a polarization optical system, the quantity of light for each pixel can also be controlled.

To put it in detail, in the case of a modulation layer 8 made of a material allowing the polarization state of a passing light to change, a polarization optical system composed of a polarization plate with an optical transmissivity thereof varying in accordance with the polarization state of the light or a polarization beam splitter or the like is combined with the modulation layer 8. Then, by controlling an electric field applied to the modulation layer 8, the polarization state of a light passing through the modulation layer 8 can be changed. As a result, the optical transmissivity of the light passing through the polarization optical system also changes as well. In this way, the quantity of light for each pixel can be controlled as is the case with the embodiment described above.

In addition, in the present embodiment, the modulation layer 8 is made of a material for light modulation such as an FLC, PDLC or TN liquid crystal which fills up a gap between the reflection layer 7 and the common electrode 9. It is worth noting, however, that this description is not intended to be construed in a limiting sense. That is to say, the configuration of the modulation layer 8 is not limited to such a structure.

For example, as a light modulating means, the modulation layer 8 can be implemented by a grating light valve making use of light interference or a deformable mirror grating utilizing a metallized elastomer, the shape of which is changed by an electric field. Such a light modulating means is described in documents such as collections of academic society manuscripts "SPIE Vol. 3013, pages 165 to 171" and "SPIE Vol. 3013, pages 112 to 125". When such a light modulating means is used, the positions of the reflection layer 7 and the common electrode 9 may change. At any rate, the present invention can be applied to any light modulating means as long as the light modulating means can be put in at least 2 pixel states by a signal applied thereto.

It should be noted that such light modulating means can be classified into 3 main categories, i.e., a grating light valve having no state storing characteristic by itself or a deformable mirror display described in the SPIE Vol. 3013, pages 112 to 125, a grating light valve with a state storing characteristic described in the SPIE Vol. 3013, pages 165 to 171 and a magnetic particle display described in "Electronic Display Devices" authored by Shoichi Matsumoto.

Made of a transparent semiconductor material, the common electrode 9 is an electrode common to the memory cells 12 created on the driving layer 6. The reflection layer 7 and the modulation layer 8 are sandwiched by the driving layer 6 and the common electrode 9 with the transparent semiconductor material facing the driving layer 6.

When a light generated by the light source 1 is radiated to the optical spatial modulation device 3 described above as shown in FIG. 1, the light from the light source 1 passes through the common electrode 9 made of the transparent semiconductor material, entering the modulation layer 8 for carrying out optical modulation on the light for each pixel. The light modulated by the modulation layer 8 is then reflected by the reflection layer 7. Then, the reflected light again undergoes optical modulation for each pixel by the modulation layer 8 before passing through the common electrode 9 to be finally transmitted to the projection optical system 4.

At that time, by controlling an electric field applied to the modulation layer 8 for each pixel, the optical transmissivity of the modulation layer 8 can be controlled for each pixel. In this way, a light modulated by the modulation layer 8 is output as a reflected light. That is to say, in this optical spatial modulation device 3, by controlling the electric field applied to the modulation layer 7 from the driving layer 6 for each memory cell 112, the reflectance of the modulation layer 8 can be controlled for each pixel.

In addition, the optical spatial modulation device 3 is capable of changing the state of the modulation layer 8 for the entire surface in a batch operation as described below. As a result, it is possible to increase the response speed, to raise the intensity and improve other characteristics. The following is a more detailed description of 4 embodiments each implementing an image display apparatus employing the optical spatial modulation device 3.

$1^{st}$ Embodiment

The description begins with a $1^{st}$ embodiment wherein the modulation layer 8 does not have a state storing characteristic and it is thus necessary to sustain electric fields applied to the modulation layer 8 while an image is being displayed. In other words, since the modulation layer 8 does not have a state storing characteristic as described above, it is necessary to apply electric fields to the modulation layer 8 continuously in order to sustain a driven state of the modulation layer 8. It should be noted that, in the case of a modulation layer 8 having a state storing characteristic, on the other hand, once the modulation layer 8 is put in a driven state, it is no longer necessary to sustain the electric fields applied to the modulation layer 8 continuously.

Figure 5:
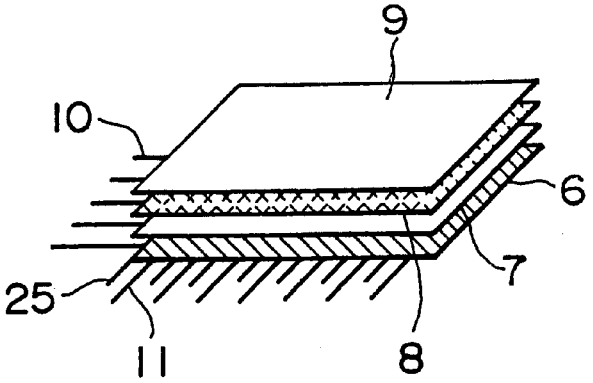
FIG. 5 is a diagram showing a squint view of a model representing a configuration of an optical spatial modulation device employed in a $1^{st}$ embodiment in a simple and plain manner.
Figure 6:
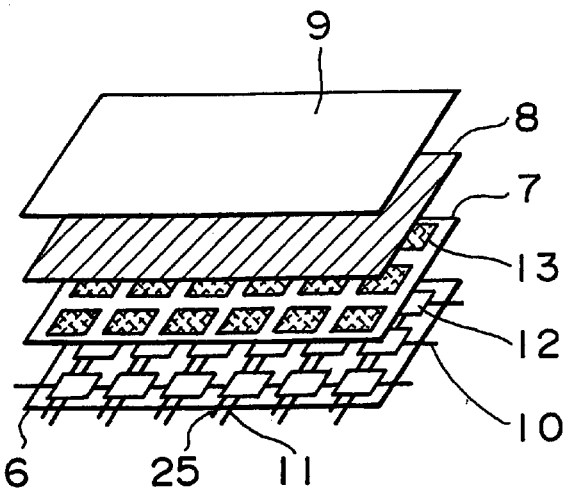
FIG. 6 is a diagram showing a squint view of a model representing a configuration of an enlarged portion of the optical spatial modulation device shown in FIG. 5 in a simple and plain manner.
Figure 7:
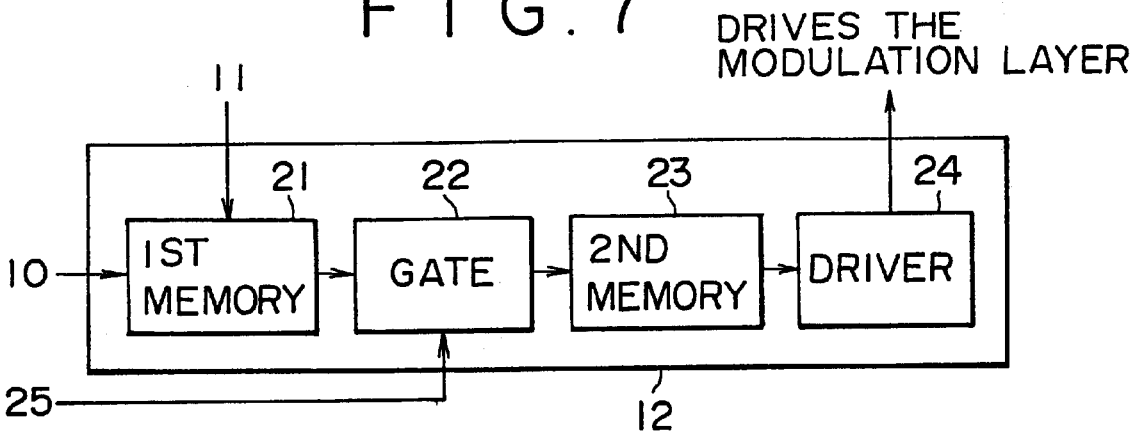
FIG. 7 is a block diagram showing the configuration of a memory cell employed in the $1^{st}$ embodiment.

In this embodiment, control lines 25 are created on the driving layer 6 of the optical spatial modulation device 3 as shown in FIGS. 5 and 6 and each of the memory cells 12 of the optical spatial modulation device 3 is designed to comprise a $1^{st}$ memory 21, a gate 22, a $2^{nd}$ memory 23 and a driver 24 as shown in FIG. 7. The $2^{nd}$ memory 23 employed in the memory cell 12 is used for storing pixel data of an image being displayed. On the other hand, pixel data of an image to be displayed next is written into the $1^{st}$ memory 21.

The $1^{st}$ memory 21 is connected to the scanning line 10 and the data line 11. Input signals coming from the scanning line 10 and the data line 11 cause pixel data for the memory cell 12 connected to the scanning line 10 and the data line 11 to be written into the $1^{st}$ memory 21 of the memory cell 12. To put it concretely, in order to display an image, data of each pixel for indicating whether a portion of the modulation layer 8 corresponding to the pixel is to be put in an initial state or a driven state is written into the $1^{st}$ memory 21 of the memory cell 12 corresponding to the portion of the modulation layer 8.

Provided between the $1^{st}$ and $2^{nd}$ memories 21 and 23, the gate 22 is controlled into closed and open states by a control signal supplied by the control line 25. When the gate 22 is put in an open state by the control signal from the control line 25, pixel data stored in the $1^{st}$ memory 21 is transferred to the $2^{nd}$ memory 23.

Pixel data stored in the $1^{st}$ memory 21 is transferred to the $2^{nd}$ memory 23 by way of the gate 22. Then, the driver 24 is driven in accordance with the pixel data transferred to the $2^{nd}$ memory 23. That is to say, the $2^{nd}$ memory 23 is used for holding pixel data of an image being displayed.

Driven in accordance with the pixel data transferred to the $2^{nd}$ memory 23, the driver 24 changes the state of the pixel. To put it concretely, the driver 24 changes an electric field applied to the modulation layer 8 in accordance with the pixel data transferred to the $2^{nd}$ memory 23, putting the modulation layer 8 in an initial or driven state.

Figure 8A:
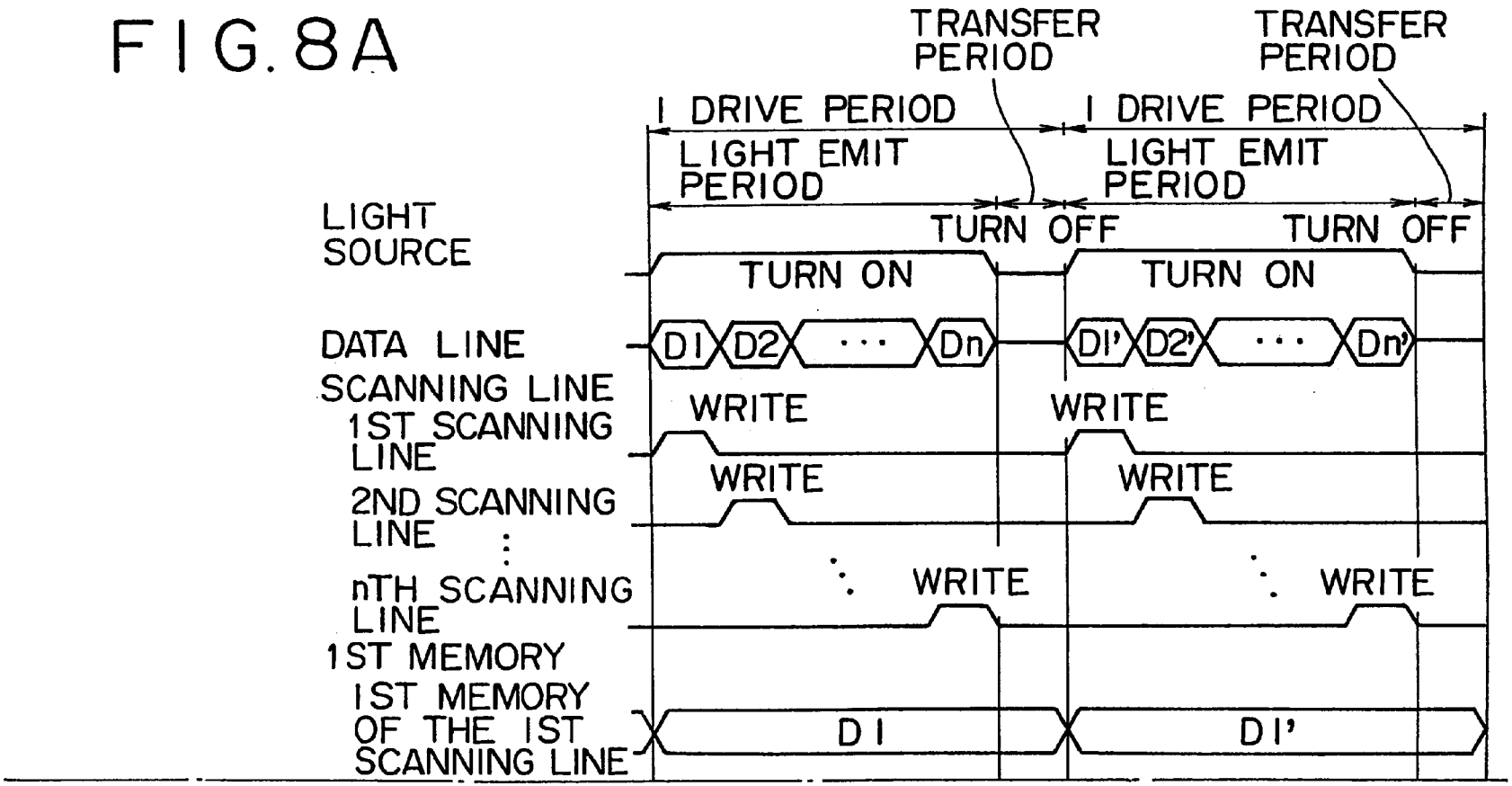
FIG. 8, consisting of FIGS. 8A through 8B, is driving timing charts of timing of operations to drive a light source and an optical spatial modulation device employed in an image display apparatus implemented by the $1^{st}$ embodiment.
Figures 8, 8B:
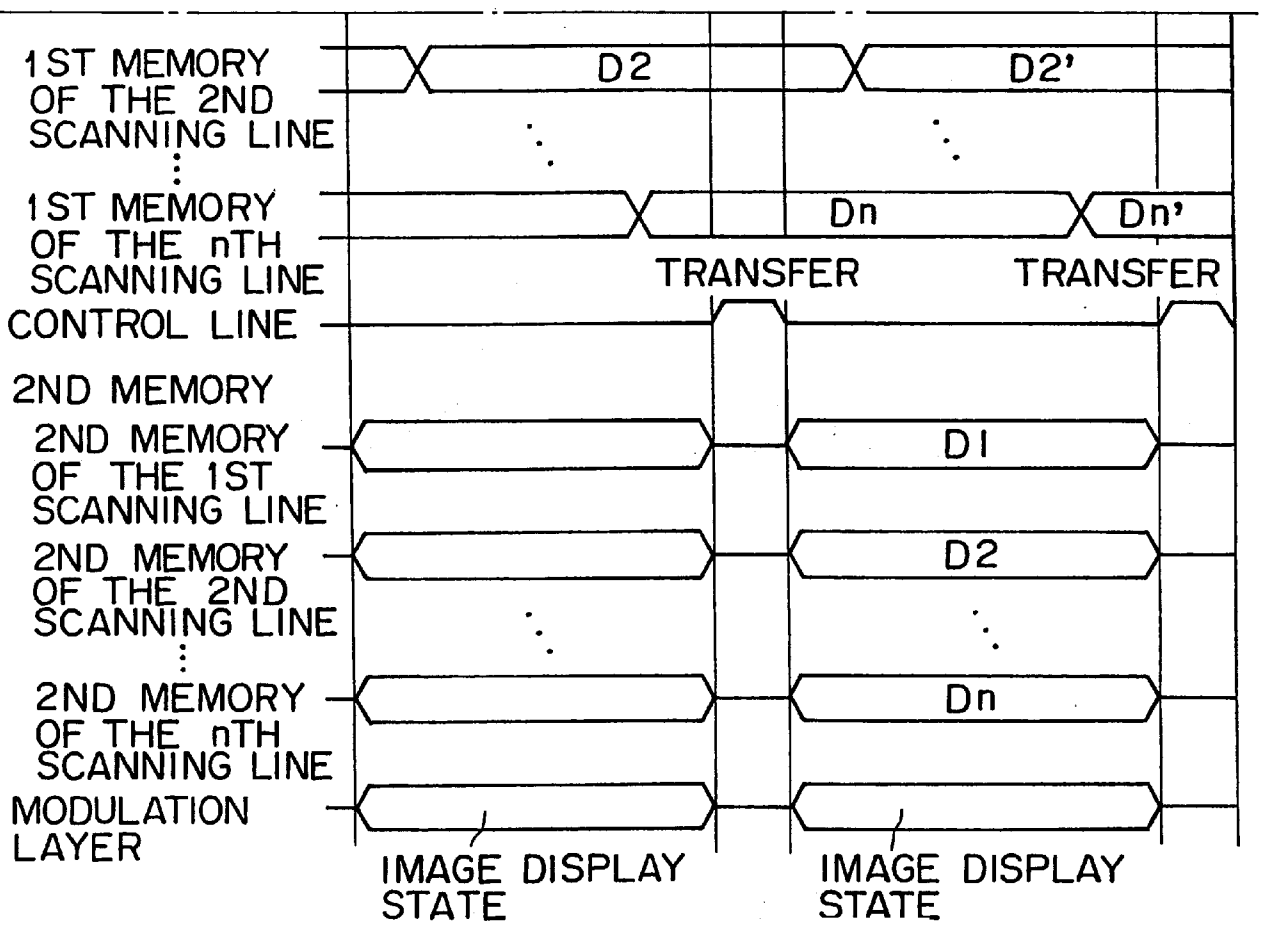

The following is a description of a driving method adopted in the image display apparatus employing the optical spatial modulation device 3, on which a memory cell 12 described above is created for each pixel, by referring to timing charts shown in FIG. 8. It should be noted that the number of scanning lines 10 of the optical spatial modulation device 3 is n.

The timing charts shown in FIG. 8 represent a period of time required to display 2 screens. That is to say, the period of time comprises a period for displaying a $1^{st}$ image and a period for displaying a $2^{nd}$ image, an image immediately following the $1^{st}$ image. It should be noted that, in an operation to display images, a period required for displaying 1 image is actually a very short period of the order of milliseconds, microseconds or even nanoseconds.

As shown in FIG. 8, a drive period, that is, a period required for displaying an image, comprises a light emit period and a transfer period. The light emit period is a period during which the light source 1 is turned on, causing an image to be displayed on the screen 5. On the other hand, the transfer period is a period during which pixel data is transferred from the $1^{st}$ memory 21 to the $2^{nd}$ memory 23. During the transfer period, the light source 1 is turned off.

The light emit period is also a period during which pixel data of an image to be displayed next is written into the $1^{st}$ memory 21. That is to say, during the light emit period for displaying a $1^{st}$ image, pieces of pixel data of a $2^{nd}$ image are sequentially written into the $1^{st}$ memory 21 of each of the memory cells 12 selected by the scanning line 10 and the data line 11.

To put it concretely, during the light emit period for displaying a $1^{st}$ image, first of all, pixel data D1 of a $2^{nd}$ image is supplied to the data lines 11 and a write signal is supplied to the $1^{st}$ scanning line 10. As a result, the pixel data D1 is written into the $1^{st}$ memory 21 of each of the memory cells 12 connected to the $1^{st}$ scanning line. It should be noted that the pixel data D1 is pixel data of the $2^{nd}$ image for pixels corresponding to memory cells 12 connected to the $1^{st}$ scanning line.

Next, pixel data D2 of the $2^{nd}$ image is supplied to the data lines 11 and a write signal is supplied to the $2^{nd}$ scanning line 10. As a result, the pixel data D2 is written into the $1^{st}$ memory 21 of each of the memory cells 12 connected to the $2^{nd}$ scanning line. It should be noted that the pixel data D2 is pixel data of the $2^{nd}$ image for pixels corresponding to memory cells 12 connected to the $2^{nd}$ scanning line.

Thereafter, pieces of pixel data of the $2^{nd}$ image are written for the subsequent scanning lines 10 in the same way. Finally, pixel data Dn of a $2^{nd}$ image is supplied to the data lines 11 and a write signal is supplied to the $n^{th}$ scanning line 10. As a result, the pixel data Dn is written into the $1^{st}$ memory 21 of each of the memory cells 12 connected to the $n^{th}$ scanning line. It should be noted that the pixel data Dn is pixel data of the $2^{nd}$ image for pixels corresponding to memory cells 12 connected to the $n^{th}$ scanning line.

As described above, pixel data of an image to be displayed next is written into all $1^{st}$ memories 21 during the light emit period. During the light emit period, nothing but the operation to write pixel data of an image to be displayed next into all $1^{st}$ memories 21 is carried out and pixel data required for driving the modulation layer 8 is already stored in the $2^{nd}$ memories 23. Thus, the states of the pixels remain unchanged as they are. As a result, even if the light source 1 is turned on throughout the light emit period, no disorder state will result in the light reflected by the optical spatial modulation device 3. That is to say, in this optical spatial modulation device 3, since pixel data required for driving the modulation layer 8 is stored in the $2^{nd}$ memory 23, pixel data required to display a next image can be written into the $1^{st}$ memory even while the driver 24 is being driven by the pixel data already stored in the $2^{nd}$ memory 23.

After pixel data of an image to be displayed next has been written into the $1^{st}$ memories 21 for all the memory cells 12, the light source 1 is turned off, letting the optical spatial modulation device 3 enter the transfer period. In the transfer period, a control signal from the control line 25 is supplied to each of the gates 22, opening the gates 22 for all the memory cells 12. As a result, pixel data is transferred from the $1^{st}$ memories 21 to the $2^{nd}$ memories 23 as a batch for all the memory cells 12.

After pixel data has been transferred from the $1^{st}$ memories 21 to the $2^{nd}$ memories 23 as a batch for all the memory cells 12, the optical spatial display device 3 transits to a period for displaying the $2^{nd}$ image. In this period, the driver 24 is driven in accordance with pixel data written in the $2^{nd}$ memory 23 and the modulation layer 8 is set in an image displaying state, that is, a state according to an image to be displayed, so that the $2^{nd}$ image is displayed. In this state, the light source 1 is turned on. As a result, the $2^{nd}$ image is displayed on the screen 5. It should be noted that, while the $2^{nd}$ image is being displayed, pieces of pixel data D1', D2', - - - , Dn' of an image following the $2^{nd}$ image are written into the $1^{st}$ memories 21 in the same way as the pieces of pixel data D1, D2, - - - , Dn of the $2^{nd}$ image were written into the $1^{st}$ memories 21.

As described above, in this optical spatial modulation device 3, instead of changing the states of pixels in scanning line unit, the states of all the pixels can be changed in a batch operation. That is to say, by using the optical spatial modulation device 3, a displayed image is not updated in scanning line units, but can be updated in as a batch for the entire screen.

In addition, in this image display apparatus, since the states of the modulation layer 8 are sustained except during a transfer period for transferring pixel data from the $1^{st}$ memories 21 to the $2^{nd}$ memories 23 as a batch, the light source 1 can be put in an on state. As a result, the light emit period per image can be lengthened and the light utilization rate can be increased.

$2^{nd}$ Embodiment

The following is a description of a $2^{nd}$ embodiment wherein it is necessary to neutralize residual electric charge of the modulation layer 8. It should be noted that, in the case of the $2^{nd}$ embodiment, as a material of the modulation layer 8, a light modulation material that exhibits a change in light modulation state in response to an applied electric field without regard to the polarity of the electric field is used. That is to say, in the case of the $2^{nd}$ embodiment, the modulation layer 8 is put in a driven state when a positive or negative electric field generated by the driving layer 6 is applied thereto. With no electric field applied thereto, on the other hand, the modulation layer 8 is put in an initial state.

Figure 9:
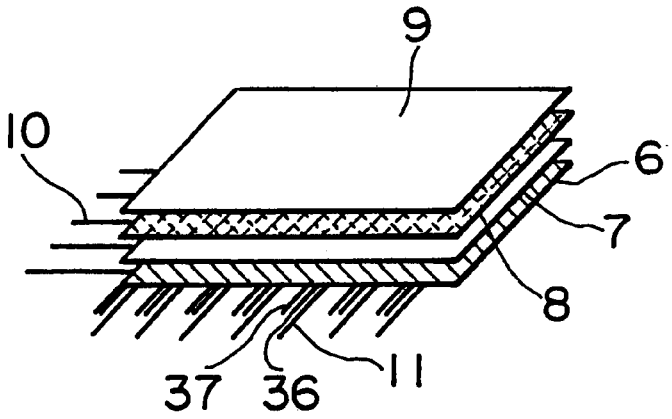
FIG. 9 is a diagram showing a squint view of a model representing the configuration of an optical spatial modulation device employed in the $2^{nd}$ embodiment in a simple and plain manner.
Figure 10:
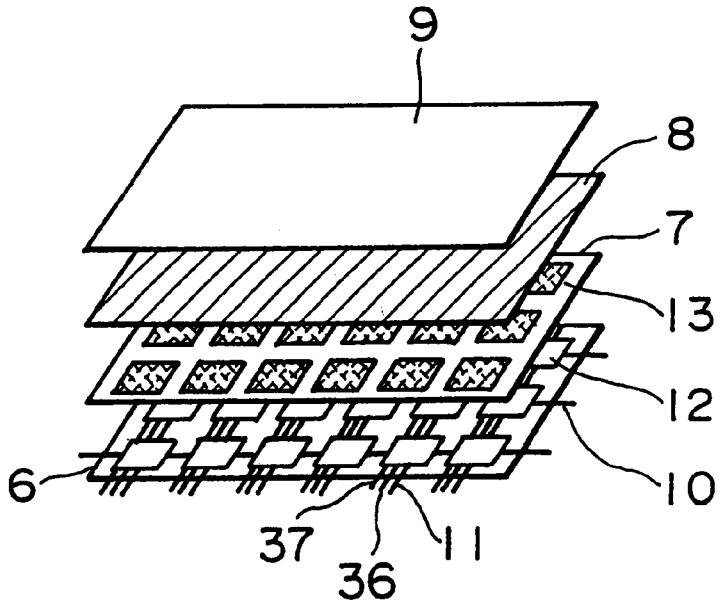
FIG. 10 is a diagram showing a squint view of a model representing a configuration of an enlarged portion of the optical spatial modulation device shown in FIG. 9 in a simple and plain manner.
Figure 11:
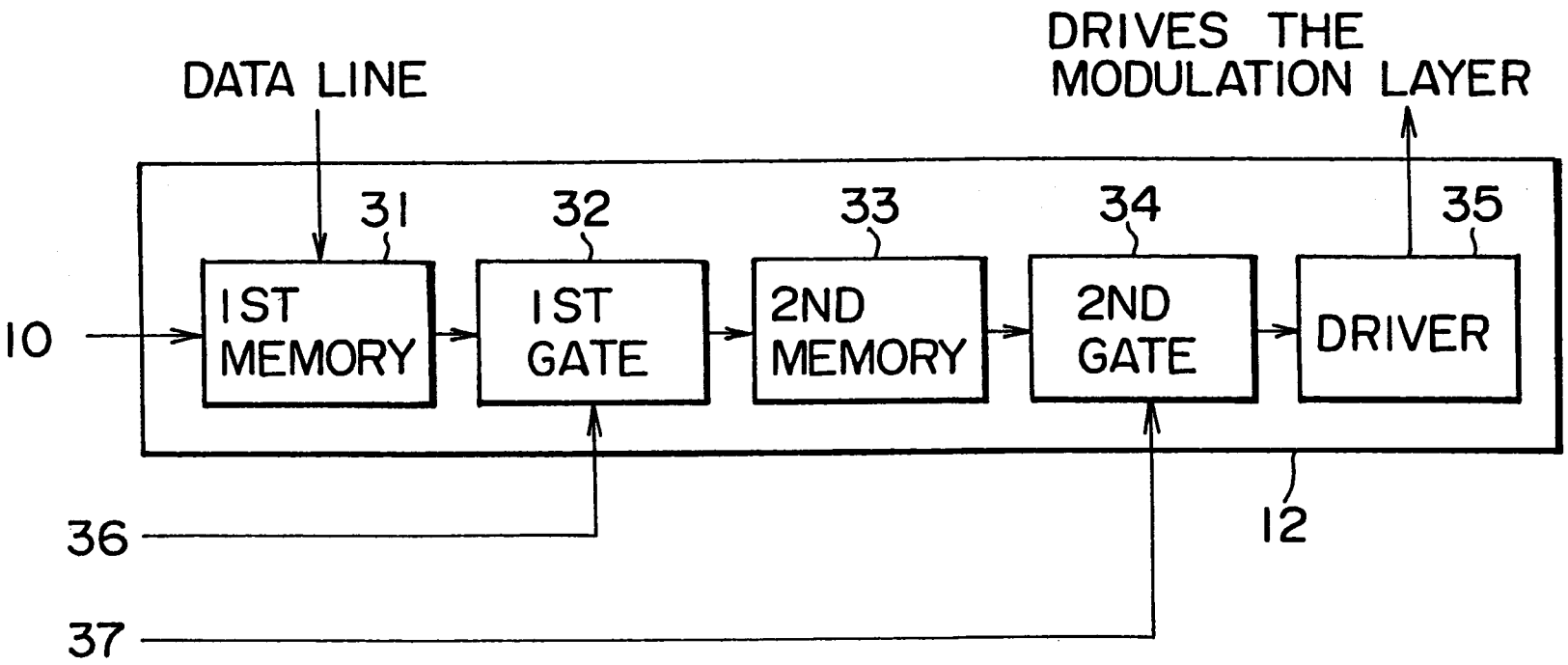
FIG. 11 is a block diagram showing the configuration of a memory cell employed in the $2^{nd}$ embodiment.

In the $2^{nd}$ embodiment, $1^{st}$ control lines 36 and $2^{nd}$ control lines 37 are created on the driving layer 6 of the optical spatial modulation device 3 as shown in FIGS. 9 and 10 and each of the memory cells 12 of the optical spatial modulation device 3 is designed to comprise a $1^{st}$ memory 31, a $1^{st}$ gate 32, a $2^{nd}$ memory 33, a $2^{nd}$ gate 34 and a driver 35 as shown in FIG. 11. The $2^{nd}$ memory 33 employed in the memory cell 12 is used for storing pixel data of an image being displayed. On the other hand, pixel data of an image to be displayed next is written into the $1^{st}$ memory 31.

The $1^{st}$ memory 31 is connected to the scanning line 10 and the data line 11. Input signals coming from the scanning line 10 and the data line 11 cause pixel data for the memory cell 12 connected to the scanning line 10 and the data line 11 to be written into the $1^{st}$ memory 31 of the memory cell 12. To put it concretely, in order to display an image, data of each pixel for indicating whether a portion of the modulation layer 8 corresponding to the pixel is to be put in an initial state or a driven state is written into the $1^{st}$ memory 31 of the memory cell 12 corresponding to the portion of the modulation layer 8.

Provided between the $1^{st}$ and $2^{nd}$ memories 31 and 33, the $1^{st}$ gate 32 is controlled into closed and open states by a control signal supplied by the $1^{st}$ control line 36. When the $1^{st}$ gate 32 is put in an open state by the control signal from the $1^{st}$ control line 36, pixel data stored in the $1^{st}$ memory 31 is transferred to the $2^{nd}$ memory 33.

Pixel data stored in the $1^{st}$ memory 31 is transferred to the $2^{nd}$ memory 33 by way of the $1^{st}$ gate 32. Then, the driver 35 is driven in accordance with the pixel data transferred to the $2^{nd}$ memory 33. That is to say, the $2^{nd}$ memory 33 is used for holding pixel data of an image being displayed.

Provided between the $2^{nd}$ memory 33 and the driver 35, the $2^{nd}$ gate 34 controls the polarity of pixel data supplied to the driver 35 from the $2^{nd}$ memory 33 in accordance with a control signal supplied by the $2^{nd}$ control line 37. That is to say, in this memory cell 12, pixel data supplied to the driver 35 from the $2^{nd}$ memory 33 can be inverted by the $2^{nd}$ gate 34.

The driver 35 drives the modulation layer 8 in accordance with the pixel data supplied thereto from the $2^{nd}$ memory 33 by way of the $2^{nd}$ gate 34 in order to change the state of the pixel. To put it concretely, the driver 35 changes an electric field applied to the modulation layer 8 in accordance with the pixel data supplied thereto from the $2^{nd}$ memory 33 by way of the $2^{nd}$ gate 34, putting the modulation layer 8 in either an initial state or a driven state.

Figure 12A:
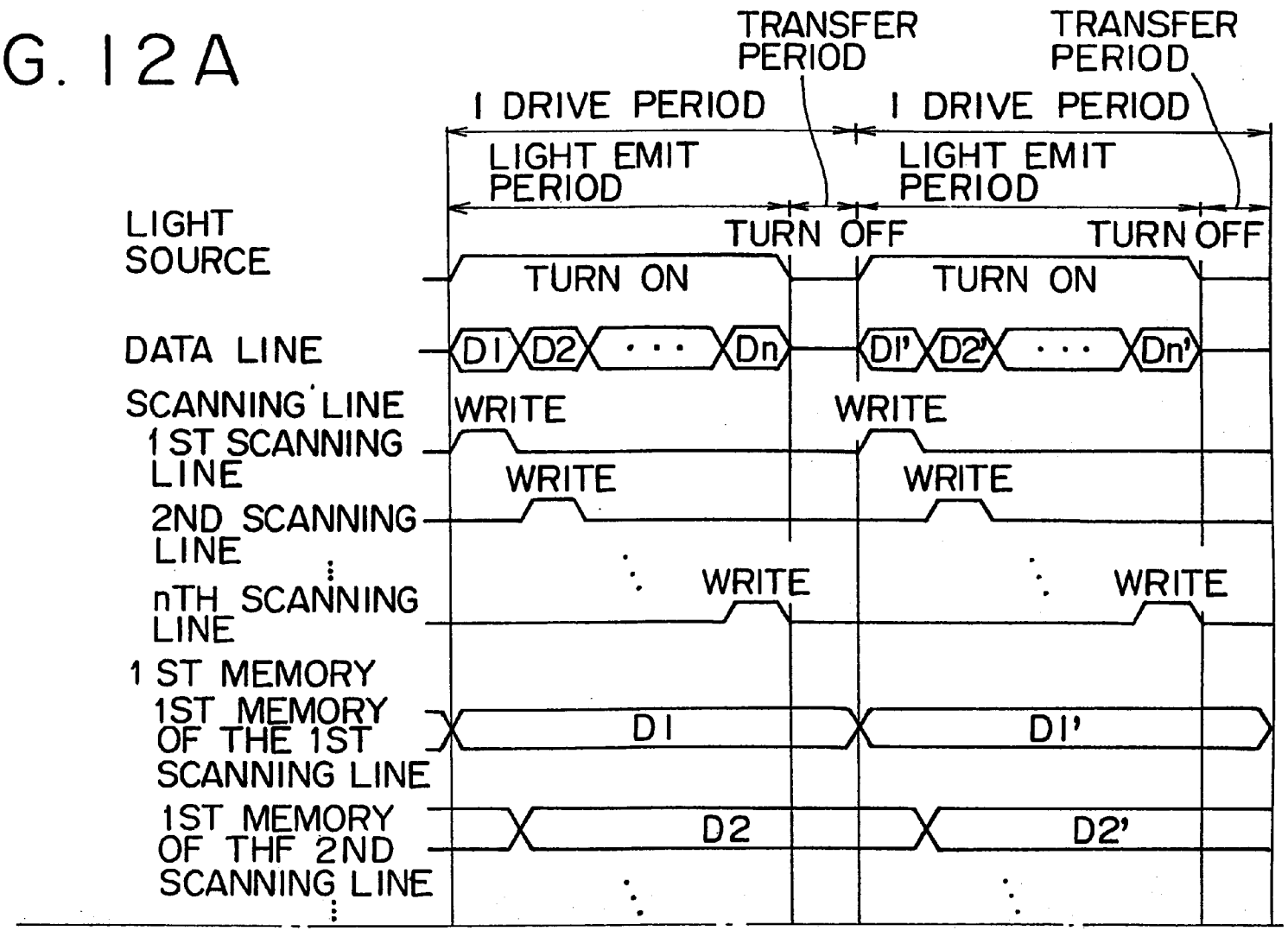
FIG. 12, consisting of FIGS. 12A through 12B, is driving timing charts of timing of operations to drive a light source and an optical spatial modulation device employed in an image display apparatus implemented by the $2^{nd}$ embodiment.
Figures 12, 12B:
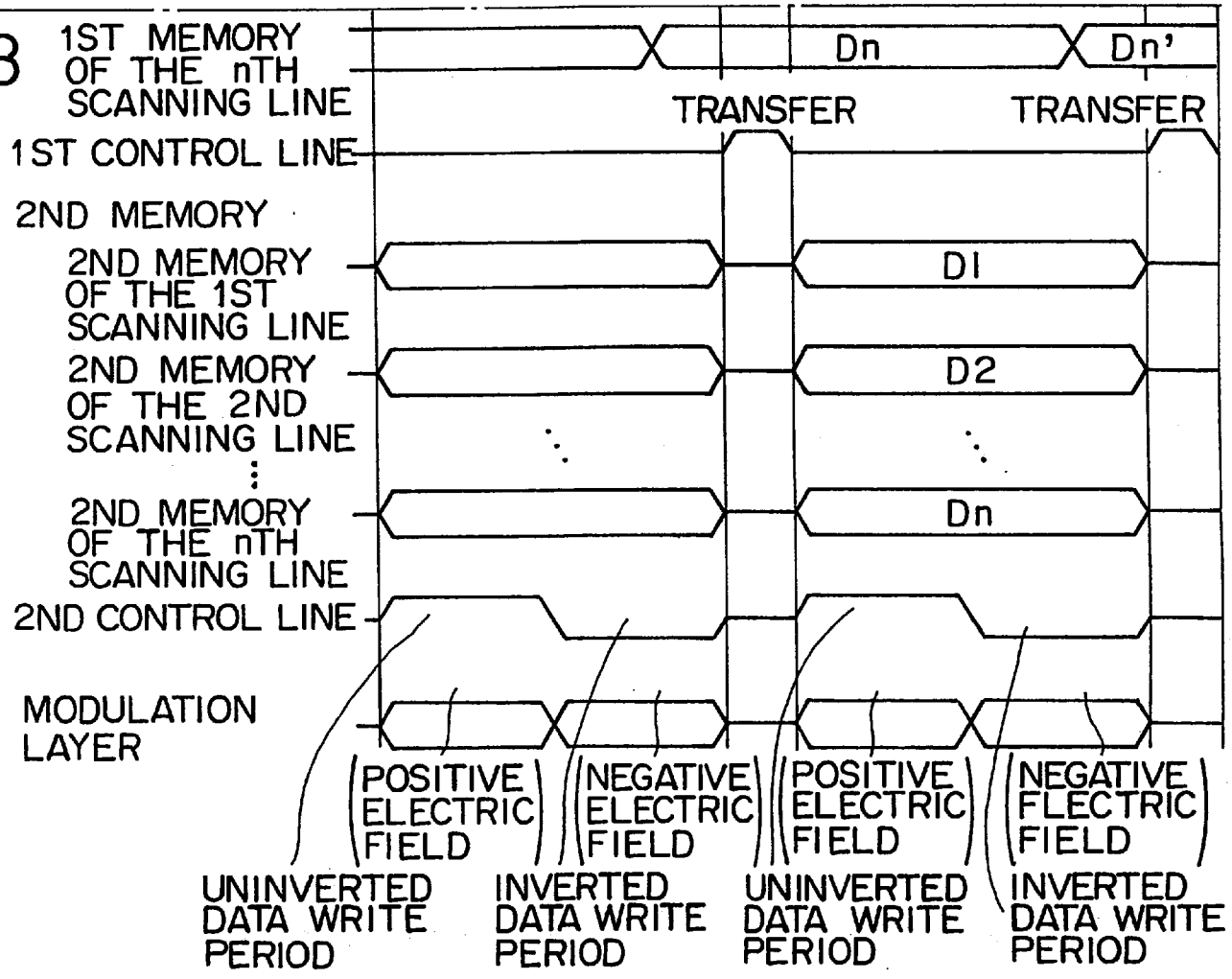

The following is a description of a driving method adopted in the image display apparatus employing the optical spatial modulation device 3, on which a memory cell 12 described above is created for each pixel, by referring to timing charts shown in FIG. 12.

Much like the $1^{st}$ embodiment, in the $2^{nd}$ embodiment, a period required for displaying an image comprises a light emit period and a transfer period. The light emit period is a period during which all pixel data of an image to be displayed next is written into the $1^{st}$ memory 31. On the other hand, the transfer period is a period during which pixel data is transferred from the $1^{st}$ memory 31 to the $2^{nd}$ memory 33 as a batch.

To put it in detail, during the light emit period for displaying a $1^{st}$ image, pieces of pixel data representing a $2^{nd}$ image are sequentially written into the $1^{st}$ memory 31 of each of the memory cells 12 selected by the scanning line 10 and the data line 11. Then, after all pixel data of the $2^{nd}$ image to be displayed next have been written into the $1^{st}$ memories 31, the optical spatial modulation device 3 enters a transfer period during which a control signal is supplied to the $1^{st}$ gate 32 from the $1^{st}$ control line 36, causing all the pixel data to be transferred from the $1^{st}$ memories 31 to the $2^{nd}$ memories 33 as a batch. Then, after all the pixel data has been transferred, the optical spatial modulation device 3 again enters a light emit period in which the pixel data transferred to the $2^{nd}$ memory 33 is supplied to the driver 35 by way of the $2^{nd}$ gate 34. The driver 35 then puts the modulation layer 8 in either an initial state or a driven state for each pixel in accordance with the pixel data transferred to the $2^{nd}$ memory 33. Much like the $1^{st}$ embodiment, in the $2^{nd}$ embodiment, the light emit period per image can be lengthened and the light utilization rate can be increased.

However, the $2^{nd}$ embodiment is different from the $1^{st}$ embodiment in that, in the case of the former, pixel data supplied to the driver 35 during the light emit period can be inverted. To be more specific, in the case of the $2^{nd}$ embodiment, a control signal supplied to the $2^{nd}$ gate 34 from the $2^{nd}$ control line 37 during the light emit period can be used for inverting pixel data supplied to the driver 35 in the $2^{nd}$ gate 34. Thus, the light emit period comprises an uninverted data write period and an inverted data write period. During the uninverted data write period, pixel data is supplied to the driver 35 as it is. During the inverted data write period, on the other hand, inverted pixel data is supplied to the driver 35.

As described above, during the inverted data write period, inverted pixel data is supplied to the driver 35. Thus, the polarity of an electric field applied to the modulation layer 8 in the inverted data write period is opposite to the polarity in the uninverted data write period. It should be noted that, in the case of the $2^{nd}$ embodiment, as a material of the modulation layer 8, a light modulation material that exhibits a change in light modulation state in response to an applied electric field without regard to the polarity of the electric field is used. As a result, the light modulation by the modulation layer 8 during the uninverted data write period is the same as the light modulation by the modulation layer 8 during the inverted data write period.

By inverting pixel data supplied to the driver 35 during the light emit period as described above, a positive or negative electric field applied to the modulation layer 8 is no longer sustained all the time. That is to say, when displaying an image, a positive electric field is applied to the modulation layer 8 for a period of time equal to a period during which a negative electric field is applied. Thus, since no residual electric charge is accumulated in the modulation layer 8, the modulation layer 8 can be sustained at a neutral polarity. As a result, the modulation layer 8 is capable of operating in a stable state for a long period of time. It should be noted that, when pixel data is inverted as described above, the light source 1 can be turned off in a transient state between an uninverted data write period and an inverted data write period.

As described above, in the case of the $2^{nd}$ embodiment, as a material of the modulation layer 8, a light modulation material that exhibits a change in light modulation state in response to an applied electric field without regard to the polarity of the electric field is used. It is worth noting that, as a material of the modulation layer 8, a light modulation material that exhibits a change in light modulation state in response to inversion of an applied electric field can also be used. In this case, the light source 1 can be turned off in the inverted data write period.

$3^{rd}$ Embodiment

In the case of a $3^{rd}$ embodiment, a light modulation material having a state storing characteristic such as the FLC and the PDLC is used as a material of the modulation layer 8. When displaying an image, an electric field is applied to the modulation layer 8 only when it is necessary to change the modulation layer from an initial state to a driven state. The modulation layer 8 is reset to an initial state before displaying a next image.

Figure 13:
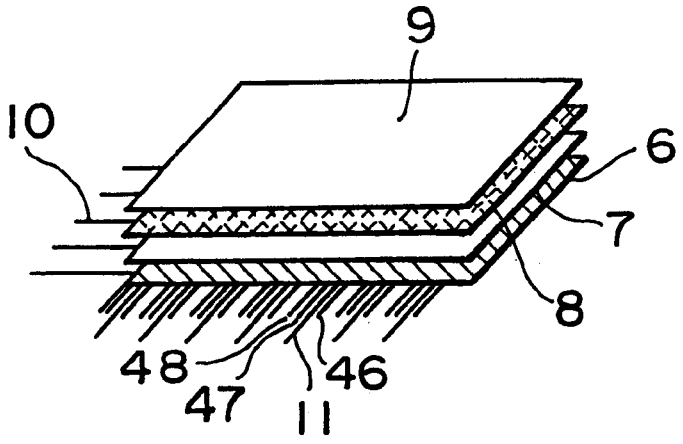
FIG. 13 is a diagram showing a squint view of a model representing the configuration of an optical spatial modulation device employed in a $3^{rd}$ embodiment in a simple and plain manner.
Figure 14:
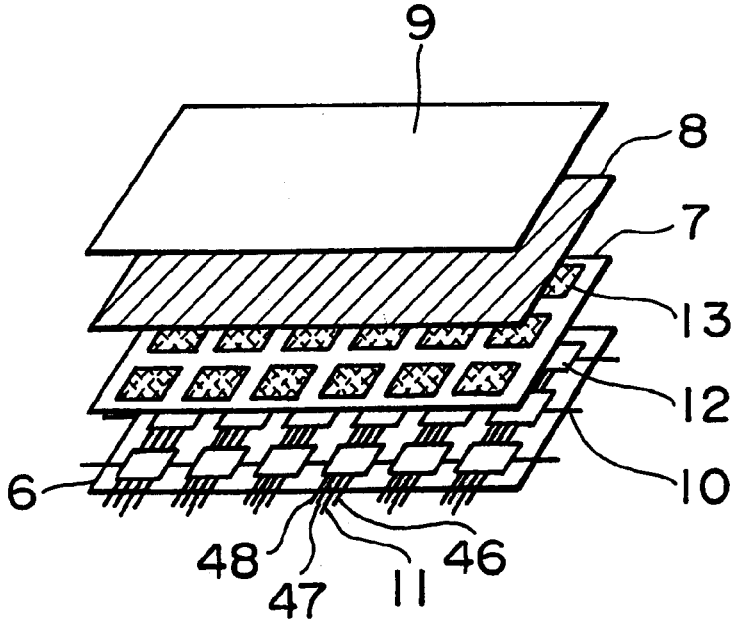
FIG. 14 is a diagram showing a squint view of a model representing a configuration of an enlarged portion of the optical spatial modulation device shown in FIG. 13 in a simple and plain manner.
Figure 15:
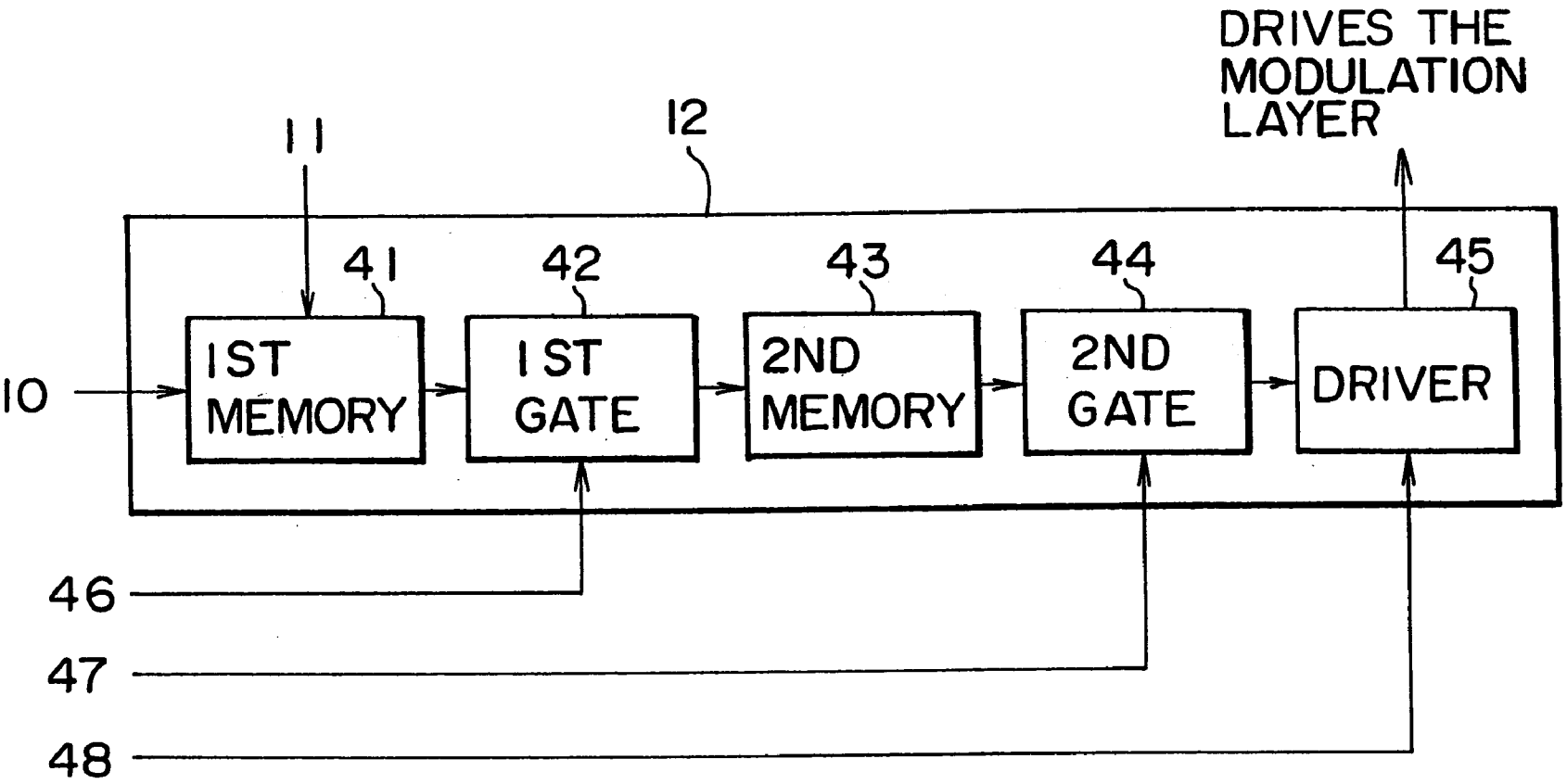
FIG. 15 is a block diagram showing the configuration of a memory cell employed in the $3^{rd}$ embodiment.

In the $3^{rd}$ embodiment, $1^{st}$ control lines 46, $2^{nd}$ control lines 47 and $3^{rd}$ control lines 48 are created on the driving layer 6 of the optical spatial modulation device 3 as shown in FIGS. 13 and 14 and each of the memory cells 12 of the optical spatial modulation device 3 is designed to comprise a $1^{st}$ memory 41, a $1^{st}$ gate 42, a $2^{nd}$ memory 43, a $2^{nd}$ gate 44 and a driver 45 as shown in FIG. 15. The $2^{nd}$ memory 43 employed in the memory cell 12 is used for storing pixel data of an image being displayed. On the other hand, pixel data of an image to be displayed next is written into the $1^{st}$ memory 41.

The $1^{st}$ memory 41 is connected to the scanning line 10 and the data line 11. Input signals coming from the scanning line 10 and the data line 11 cause pixel data for the memory cell 12 connected to the scanning line 10 and the data line 11 to be written into the $1^{st}$ memory 41 of the memory cell 12. To put it concretely, in order to display an image, data of each pixel for indicating whether a portion of the modulation layer 8 corresponding to the pixel is to be put in an initial state or a driven state is written into the $1^{st}$ memory 41 of the memory cell 12 corresponding to the portion of the modulation layer 8.

Provided between the $1^{st}$ and $2^{nd}$ memories 41 and 43, the $1^{st}$ gate 42 is controlled into closed and open states by a control signal supplied by the $1^{st}$ control line 46. When the $1^{st}$ gate 42 is put in an open state by the control signal from the $1^{st}$ control line 46, pixel data stored in the $1^{st}$ memory 41 is transferred to the $2^{nd}$ memory 43.

Pixel data stored in the $1^{st}$ memory 41 is transferred to the $2^{nd}$ memory 43 by way of the $1^{st}$ gate 42. Then, the driver 45 is driven in accordance with the pixel data transferred to the $2^{nd}$ memory 43. That is to say, the $2^{nd}$ memory 43 is used for holding pixel data of an image being displayed.

Provided between the $2^{nd}$ memory 43 and the driver 45, the $2^{nd}$ gate 44 is put in an open or closed state by a control signal supplied by the $2^{nd}$ control line 47. When the $2^{nd}$ gate 44 is put in an open state by the control signal from the $2^{nd}$ control line 47, pixel data stored in the $2^{nd}$ memory 43 is supplied to the driver 45.

The driver 45 drives the modulation layer 8 in accordance with the pixel data supplied thereto from the $2^{nd}$ memory 43 by way of the $2^{nd}$ gate 44 in order to change the state of the pixel. To put it concretely, the driver 45 changes an electric field applied to the modulation layer 8 in accordance with the pixel data supplied thereto from the $2^{nd}$ memory 43 by way of the $2^{nd}$ gate 44, putting the modulation layer 8 in either an initial state or a driven state. A $3^{rd}$ control line 48 is connected to the driver 45. Driven by a control signal coming from the $3^{rd}$ control line 48, the driver 45 is capable of driving the modulation layer 8 to return to an initial state.

Figure 16A:
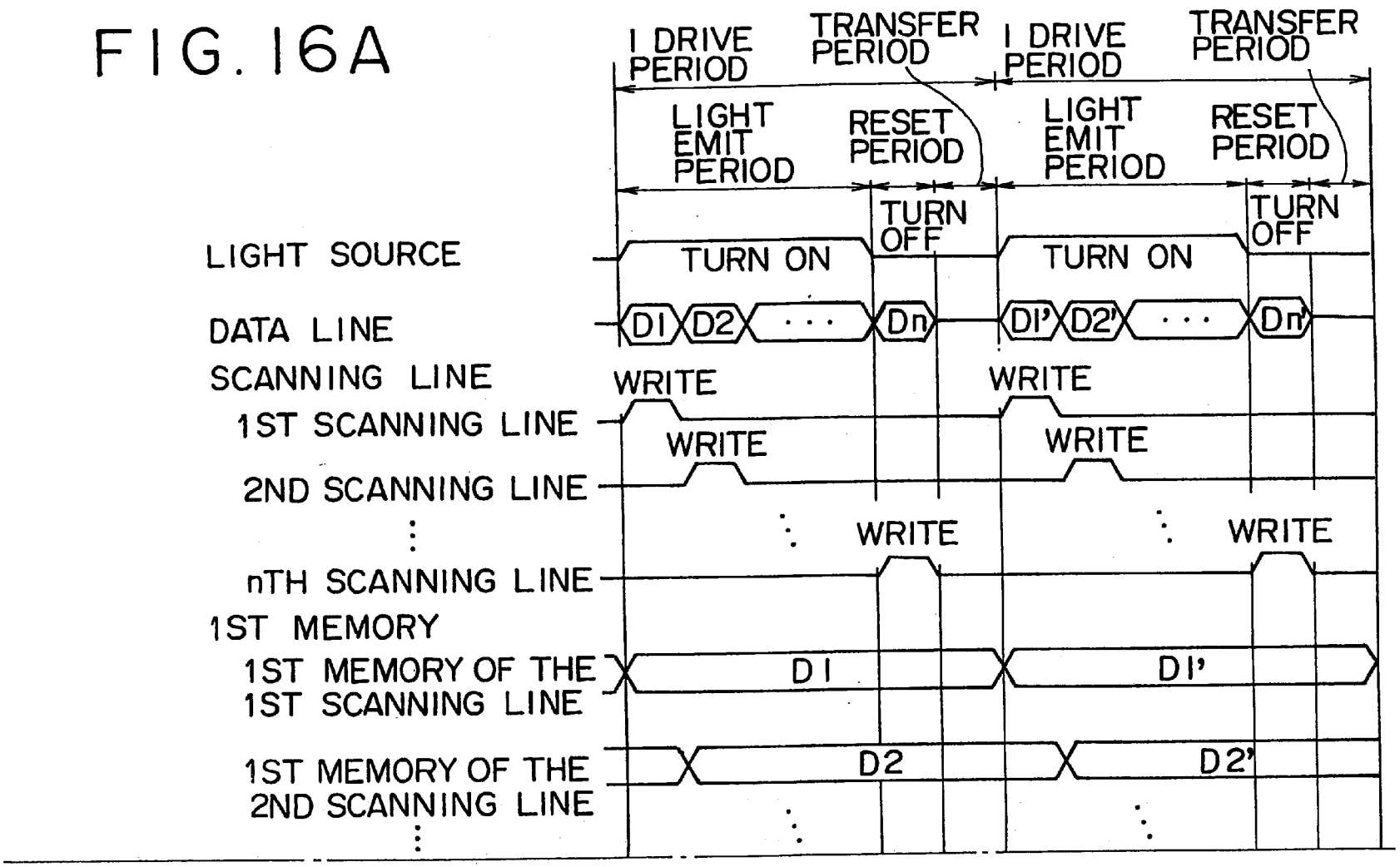
FIG. 16, consisting of FIGS. 16A through 16B, is driving timing charts of timing of operations to drive a light source and an optical spatial modulation device employed in an image display apparatus implemented by the $3^{rd}$ embodiment.
Figures 16, 16B:
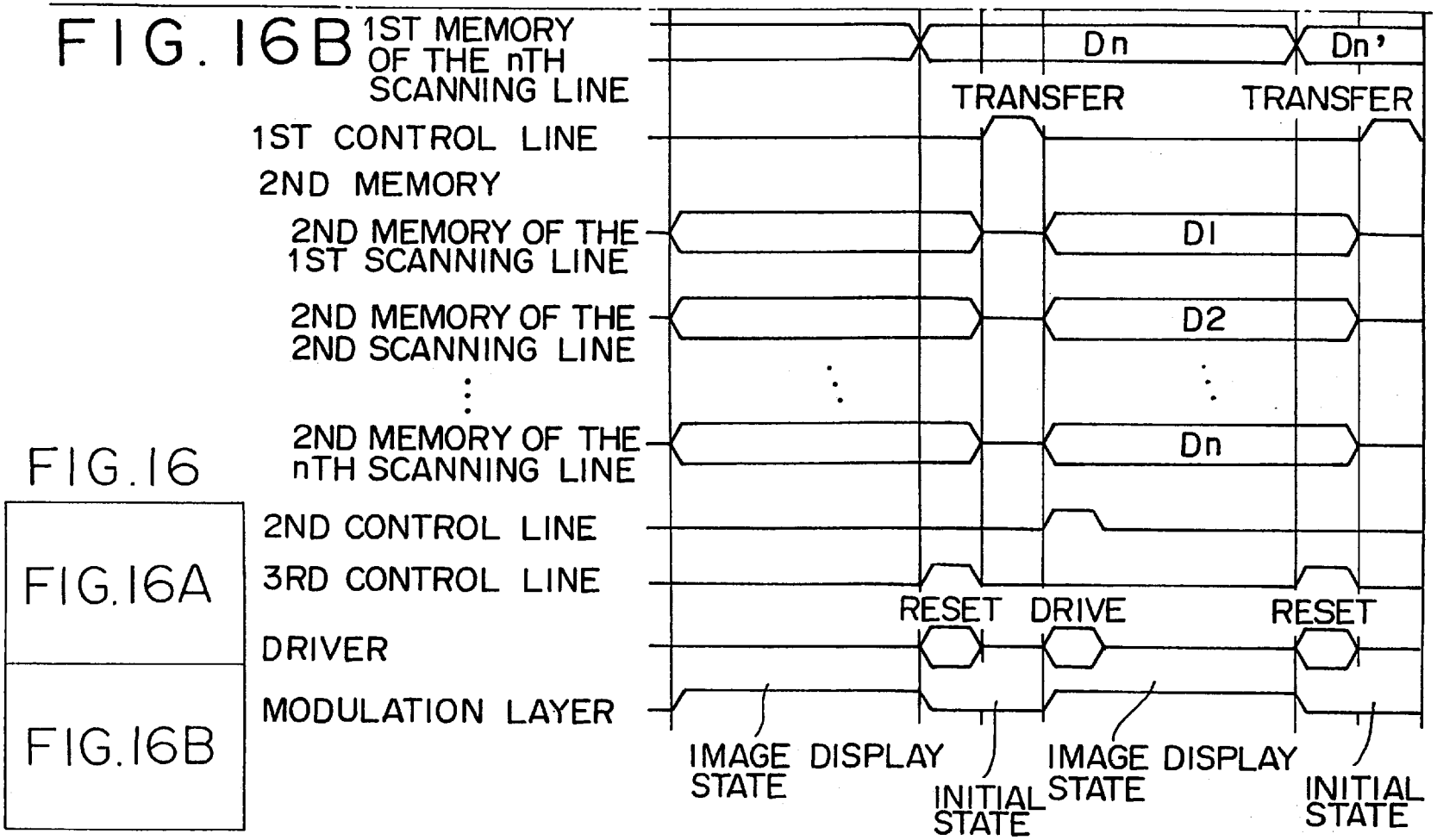

The following is a description of a driving method adopted in the image display apparatus employing the optical spatial modulation device 3, on which a memory cell 12 described above is created for each pixel, by referring to timing charts shown in FIG. 16.

As shown in FIG. 16, a period required for displaying an image comprises a light emit period, a reset period and a transfer period. The light emit period is a period during which the light source 1 is turned on and an image is displayed on the screen 5. Much like the $1^{st}$ and $2^{nd}$ embodiments, during the light emit period, all pixel data of an image to be displayed next is written into the 1st memory 41. During the reset and transfer periods, on the other hand, the light source 1 is turned off.

The reset period is a period during which the modulation layer 8 is reset to an initial state before new pixel data is transferred from the $1^{st}$ memory 41 to the $2^{nd}$ memory 43. That is to say, all pixels are put in an initial state during the reset period.

During the reset period, a control signal requesting the driver 45 to put the modulation layer 8 in an initial state is supplied from the $3^{rd}$ control line 48 to the driver 45. The driver 45 restores the entire modulation layer 8 to an initial state in accordance with the control signal. The modulation layer 8 can be reset typically by applying an electric field to the modulation layer 8 in a direction opposite to an electric field applied immediately before. It should be noted that the operation needs to be carried out only on portions of the modulation layer 8 that are not in an initial state. That is to say, during the reset period, only the drivers 45 corresponding to pixels not in an initial state need to be driven.

After all the pixels have been restored to an initial state as described above, the optical spatial modulation device 3 enters a transfer period. In the transfer period, a control signal from the $1^{st}$ control line 46 is supplied to each of the $1^{st}$ gates 42, opening the $1^{st}$ gates 42. As a result, pixel data is transferred from the $1^{st}$ memories 41 to the $2^{nd}$ memories 43 as a batch. That is to say, much like the $1^{st}$ and $2^{nd}$ embodiments, during the transfer period, all pixel data of an image to be displayed next is transferred from the $1^{st}$ memories 41 to the $2^{nd}$ memories 43 as a batch.

Then, after all the pixel data has been transferred from the $1^{st}$ memories 41 to the $3^{rd}$ memories 43 as a batch, the optical spatial modulation device 3 again enters a light emit period in which the light source 1 is turned on and, at the same time, in the beginning of the light emit period, a control signal is supplied to the $2^{nd}$ gate 44 from the $2^{nd}$ control line 47 to put the $2^{nd}$ gate 44 in an open state. As the $2^{nd}$ gate 44 is opened by this control signal, pixel data is supplied to the driver 45 from the $2^{nd}$ memory 43 to drive the driver 45.

At that time, the $2^{nd}$ gate 44 is put in an open state for a period of time required for driving the driver 45 to put the modulation layer 8 in a driven state. The driver 45 is driven while the $2^{nd}$ gate 44 is in the open state. As the open state of the $2^{nd}$ gate 44 is ended, the driving of the driver 45 is also terminated as well. In the case of the present embodiment, since the modulation layer 8 has a state storing characteristic, a pixel driven by the driver 45 into a driven state remains in the driven state as it is even after the driving of the driver 45 is ended.

It should be noted that the drivers 45 are driven only for pixels corresponding to portions of the modulation layer 8 that need to be put in a driven state. That is to say, it is not necessary to drive the drivers 45 for pixels corresponding to portions of the modulation layer 8 that are allowed to remain in an initial state as they are. Thus, it is necessary to drive the drivers 45 only for pixels corresponding to portions of the modulation layer 8 that need to be put in a driven state. In other words, in this optical spatial modulation device 3, when changing a displayed image, only the states of pixels requiring a change in state are changed from an initial state.

In an embodiment like the one described above, pixels in a driven state are reset as a batch, allowing the response speed to be increased without entailing a decrease in frame rate observed in the 2-field technique. In addition, the number of electric charge transfers is small in comparison with the 2-field technique, allowing the amount of consumed power to be reduced.

$4^{th}$ Embodiment

In the case of a $4^{th}$ embodiment, a light modulation material having a state storing characteristic such as the FLC and the PDLC is used as a material of the modulation layer 8. When the screen is changed from one image to another, only pixels involved in the screen change are updated.

Figure 17:
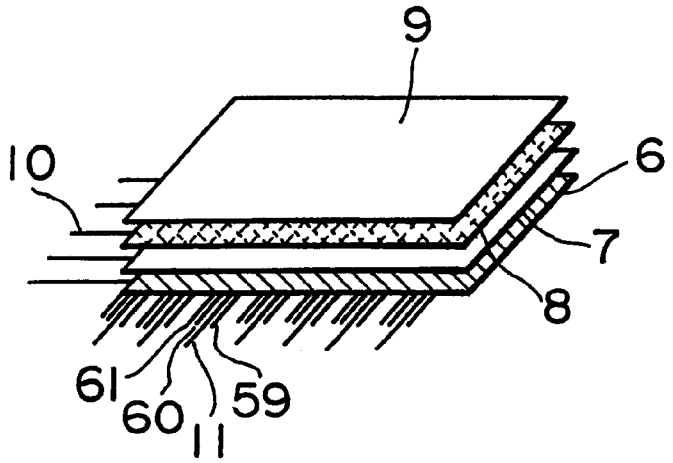
FIG. 17 is a diagram showing a squint view of a model representing the configuration of an optical spatial modulation device employed in a $4^{th}$ embodiment in a simple and plain manner.
Figure 18:
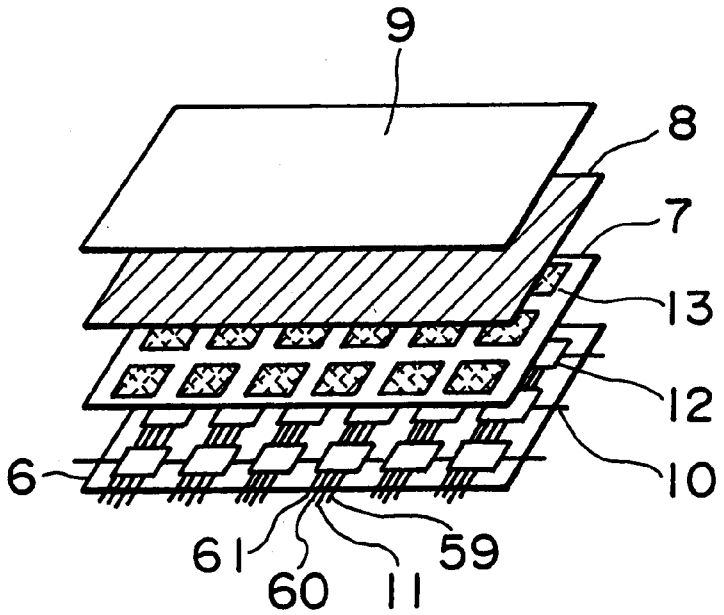
FIG. 18 is a diagram showing a squint view of a model representing a configuration of an enlarged portion of the optical spatial modulation device shown in FIG. 17 in a simple and plain manner.
Figure 19:
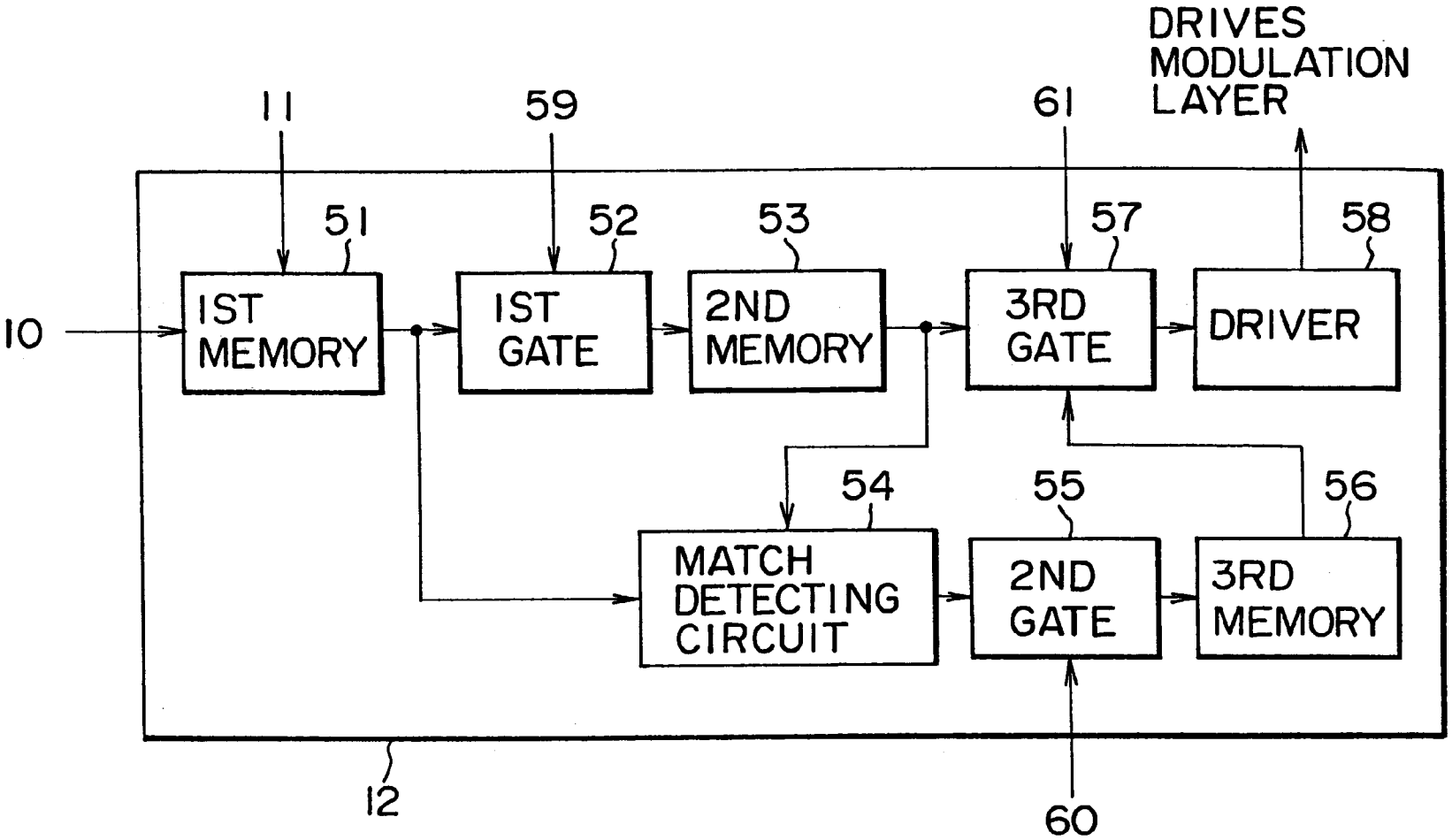
FIG. 19 is a block diagram showing the configuration of a memory cell employed in the $4^{th}$ embodiment.

In the $4^{th}$ embodiment, $1^{st}$ control lines 59, $2^{nd}$ control lines 60 and $3^{rd}$ control lines 61 are created on the driving layer 6 of the optical spatial modulation device 3 as shown in FIGS. 17 and 18 and each of the memory cells 12 of the optical spatial modulation device 3 is designed to comprise a $1^{st}$ memory 51, a $1^{st}$ gate 52, a $2^{nd}$ memory 53, a match detecting circuit 54, a $2^{nd}$ gate 55, a $3^{rd}$ memory 56, a $3^{rd}$ gate 57 and a driver 58 as shown in FIG. 19.

The $2^{nd}$ memory 53 employed in the memory cell 12 is used for storing pixel data of an image being displayed. On the other hand, pixel data of an image to be displayed next is written into the $1^{st}$ memory 51. The $3^{rd}$ memory 56 is used for storing information indicating whether or not pixel data of an image being displayed matches pixel data of an image to be displayed next. Such information is referred to hereafter as match indicating data.

The $1^{st}$ memory 51 is connected to the scanning line 10 and the data line 11. Input signals coming from the scanning line 10 and the data line 11 cause pixel data for the memory cell 12 connected to the scanning line 10 and the data line to be written into the $1^{st}$ memory 51 of the memory cell 12. To put it concretely, in order to display an image, data of each pixel for indicating whether a portion of the modulation layer 8 corresponding to the pixel is to be put in an initial state or a driven state is written into the $1^{st}$ memory 51 of the memory cell 12 corresponding to the portion of the modulation layer 8.

Provided between the $1^{st}$ and $2^{nd}$ memories 51 and 53, the $1^{st}$ gate 52 is controlled into closed and open states by a control signal supplied by the $1^{st}$ control line 59. When the $1^{st}$ gate 52 is put in an open state by the control signal from the $1^{st}$ control line 59, pixel data stored in the $1^{st}$ memory 51 is transferred to the $2^{nd}$ memory 53.

Pixel data stored in the $1^{st}$ memory 51 is transferred to the $2^{nd}$ memory 53 by way of the $1^{st}$ gate 52. As described above, the $2^{nd}$ memory 53 is used for holding pixel data of an image being displayed.

The match detecting circuit 54 compares pixel data stored in the $1^{st}$ memory 51 with pixel data stored in the $2^{nd}$ memory 53 to form a judgment as to whether or not both the pieces of pixel data match each other. As described above, the $2^{nd}$ memory 53 employed in the memory cell 12 is used for storing pixel data of an image being displayed while pixel data of an image to be displayed next is stored into the $1^{st}$ memory 51. That is to say, the match detecting circuit 54 forms a judgment as to whether or not pixel data of a current image prior to the operation matches pixel data of an image replacing the current image and outputs match indicating data which shows whether or not pixel data of an image being displayed matches pixel data of an image to be displayed next.

Provided between the $3^{rd}$ memory 56 and the match detecting circuit 54, the $2^{nd}$ gate 55 is controlled into closed and open states by a control signal supplied by the $2^{nd}$ control line 60. When the $2^{nd}$ gate 55 is put in an open state by the control signal from the $2^{nd}$ control line 60, match indicating data stored in the match detecting circuit 54 is transferred to the $3^{rd}$ memory 56.

Match indicating data stored in the match detecting circuit 54 is transferred to the $3^{rd}$ memory 56 by way of the $2^{nd}$ gate 55. Thus, an operation to change the current image being displayed is carried out by resorting to the $3^{rd}$ memory 56 which is used for storing match indicating data showing whether or not pixel data of the current image prior to the operation matches pixel data of an image replacing the current image.

Provided between the $2^{nd}$ and $3^{rd}$ memories 53 and 56 and the driver 58, the $3^{rd}$ gate 57 is controlled into closed and open states by a control signal supplied by the $3^{rd}$ control line 61. When the $3^{rd}$ gate 57 is put in an open state by the control signal from the $3^{rd}$ control line 61, pixel data stored in the $2^{nd}$ memory 53 and match indicating data stored in the $3^{rd}$ memory 56 is transferred to the driver 58.

The driver 58 is driven in accordance with the pixel data supplied from the $2^{nd}$ memory 53 by way of the $3^{rd}$ gate 57 and the match indicating data supplied from the $3^{rd}$ memory 56 by way of the $3^{rd}$ gate 57. In an operation to change a currently displayed image, the driver 58 drives only portions of the modulation layer 8 corresponding to pixels for which pixel data of the current image prior to the operation does not match pixel data of an image replacing the current image.

To put it in detail, in an operation to change a currently displayed image, the driver 58 of a memory cell 12 corresponding to a pixel applies an electric field to a portion of the modulation layer 8 corresponding to the pixel in order to put the pixel in a driven state only if the pixel data supplied from the $2^{nd}$ memory 53 is data requesting that the pixel be put in a driven state and the match indicating data supplied from the $3^{rd}$ memory 56 shows that pixel data of the current image prior to the operation does not match pixel data of an image replacing the current image By the same token, in the case of another pixel to be put in an initial state in an operation to change a currently displayed image, the driver 58 of the pixel may apply an electric field to a portion of the modulation layer 8 corresponding to the pixel in order to put the pixel in an initial state only if the pixel data supplied from the $2^{nd}$ memory 53 is data requesting that the pixel be put in an initial state and the match indicating data supplied from the $3^{rd}$ memory 56 shows that pixel data of the current image prior to the operation does not match pixel data of an image replacing the current image.

Figure 20A:
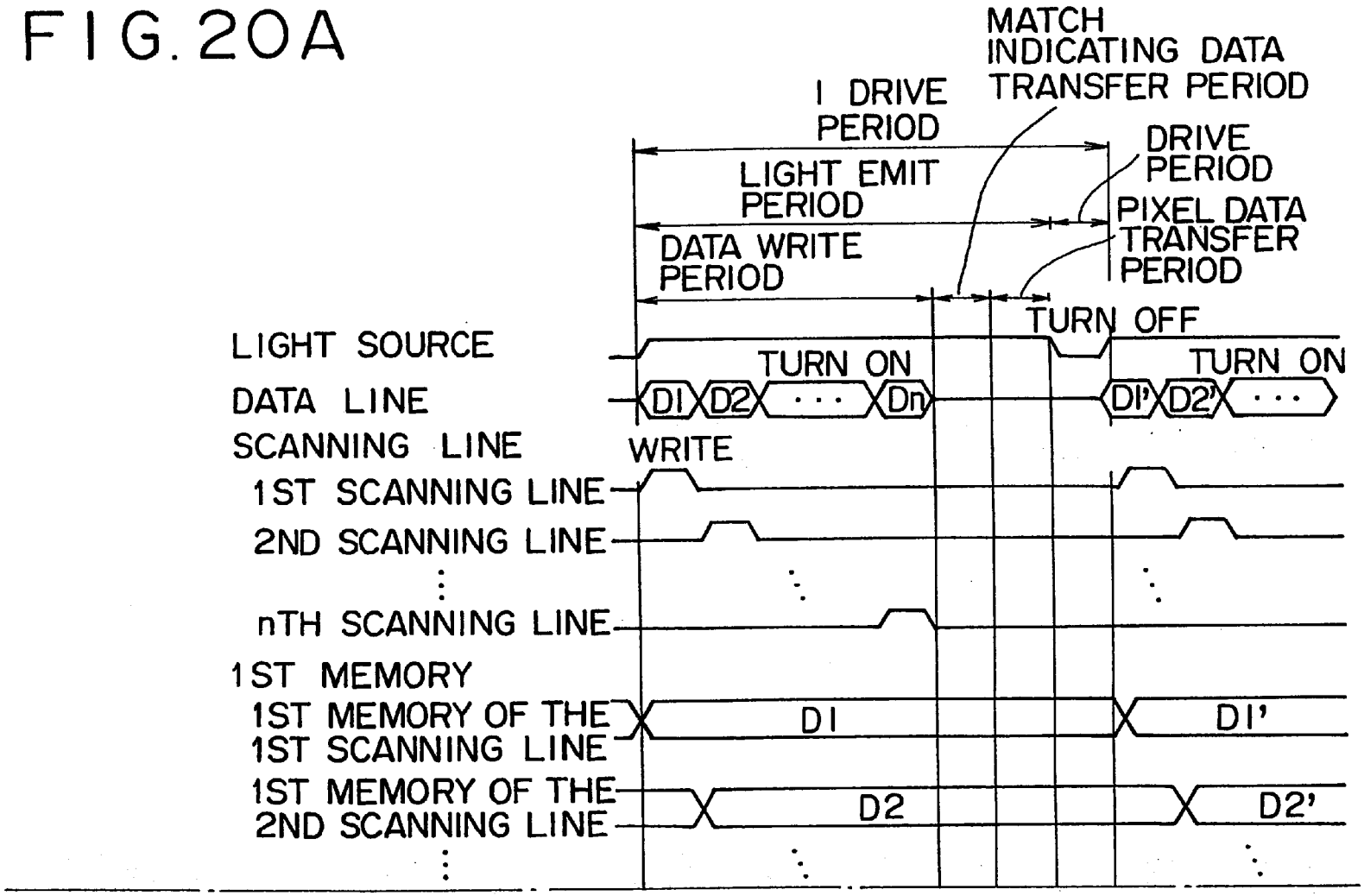
FIG. 20, consisting of FIGS. 20A through 20B, is driving timing charts of timing of operations to drive a light source and an optical spatial modulation device employed in an image display apparatus implemented by the $4^{th}$ embodiment.
Figures 20, 20B:
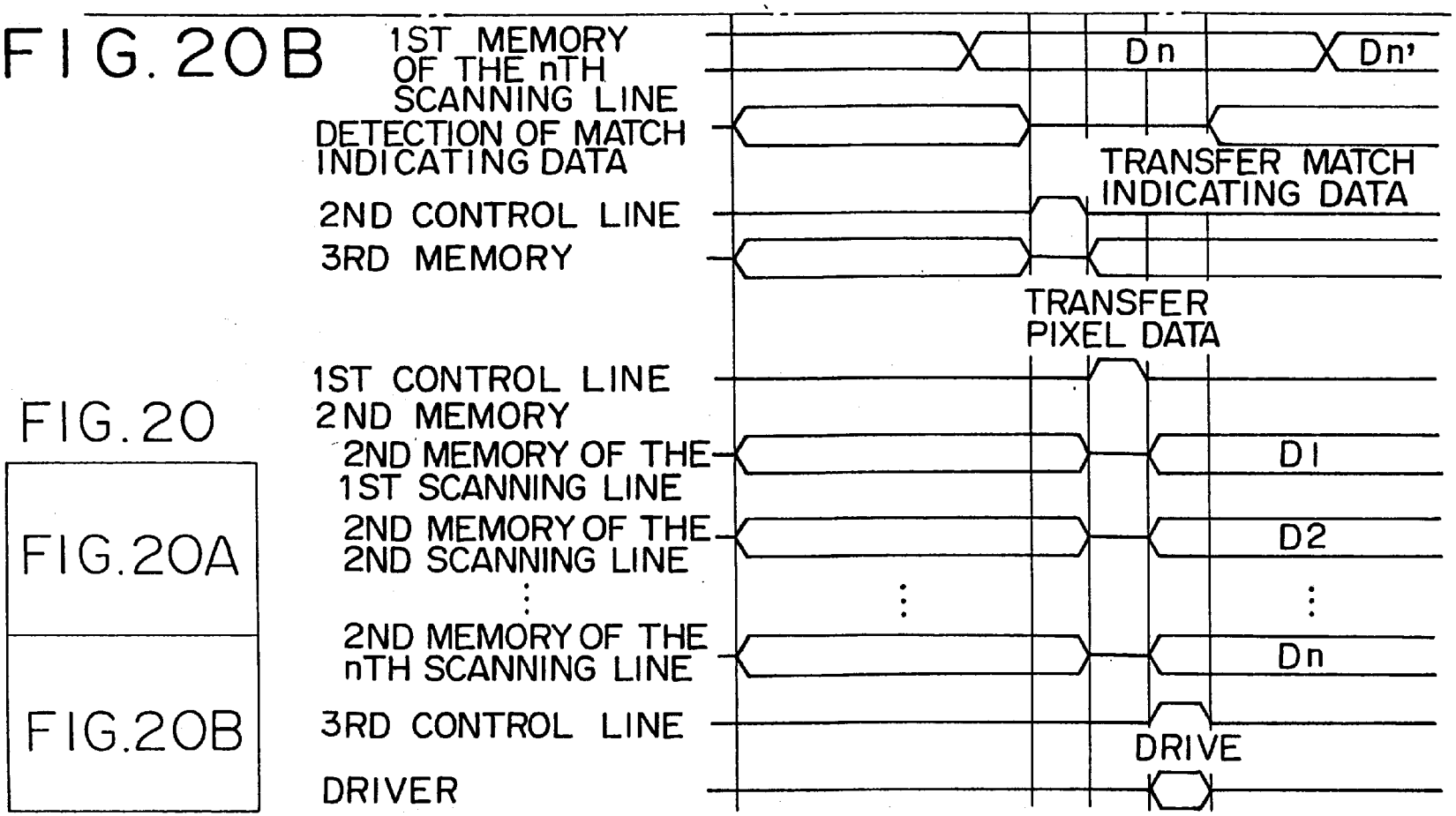

The following is a description of a driving method adopted in the image display apparatus employing the optical spatial modulation device 3, on which a memory cell 12 described above is created for each pixel, by referring to timing charts shown in FIG. 20.

As shown in FIG. 20, a period required for displaying an image comprises a light emit period and a drive period. The light emit period comprises a data write period, a match indicating data transfer period and a pixel data transfer period. The light emit period is a period during which the light source 1 is turned on and an image is displayed on the screen 5. On the other hand, the drive period is a period during which the driver 58 is driven to change the state of a pixel corresponding to the driver 58. During the drive period, the light source 1 is turned off.

The data write period of the light emit period is a period during which all pixel data of an image to be displayed next is stored in the $1^{st}$ memory 51 as is the case with the light emit period of the $1^{st}$ to $3^{rd}$ embodiments. At that time, the match detecting circuit 54 compares pixel data stored in the $2^{nd}$ memory 53, that is, pixel data of an image currently being displayed, with pixel data stored in the $1^{st}$ memory 51, that is, pixel data of an image to be displayed next.

As the operation to store all the pixel data of an image to be displayed next in the $1^{st}$ memory 51 is completed, the optical spatial modulation device 3 enters the match indicating data transfer period during which a control signal is supplied to the $2^{nd}$ gate 55 from the $2^{nd}$ control line 60 to put the $2^{nd}$ gate 55 in an open state. As a result, match indicating data is transferred from the match detecting circuit 54 to the $3^{rd}$ memory 56 as a batch.

As the operation to transfer the match indicating data from the match detecting circuit 54 to the $3^{rd}$ memory 56 is completed, the optical spatial modulation device 3 enters the pixel data transfer period during which a control signal is supplied to the $1^{st}$ gate 52 from the $1^{st}$ control line 59 to put the $1^{st}$ gate 52 in an open state. As a result, pixel data to be displayed next is transferred from the $1^{st}$ memory 51 to the $2^{nd}$ memory 53 as a batch.

As the operation to transfer the pixel data from the $1^{st}$ memory 51 to the $2^{nd}$ memory 53 is completed, the optical spatial modulation device 3 enters the drive period during which a control signal is supplied to the $3^{rd}$ gate 57 from the $3^{rd}$ control line 61 to put the $3^{rd}$ gate 57 in an open state. As a result, pixel data is transferred from the $2^{nd}$ memory 53 to the driver 58 and match indicating data is transferred from the $3^{rd}$ memory 56 to the driver 58. Receiving the pixel data and the match indicating data, the driver 58 drives the portion of the modulation layer 8 to a state indicated by the pixel data only if the match indicating data shows that pixel data of an image currently being displayed prior to the image change is different from pixel data of a replacing image to be displayed next as described above. That is to say, only the drivers 58 for pixels that need to be rewritten drive the portions of the modulation layer 8 corresponding to the pixels during the drive period.

The drive period corresponds to a period of time required by the driver 58 for changing the state of a pixel. In other words, a driver 58 that needs to be driven in an operation to change a displayed image is driven during a period of time corresponding to the drive period. Much like the $3^{rd}$ embodiment, the present embodiment employs a modulation layer 8 which has a state storing characteristic. Thus, once the driver 58 is driven for a fixed period of time in this way, a pixel with the state thereof changed by the driving of the driver 58 sustains the state even after the driving of the driver 58 is ended immediately.

Figure 21:
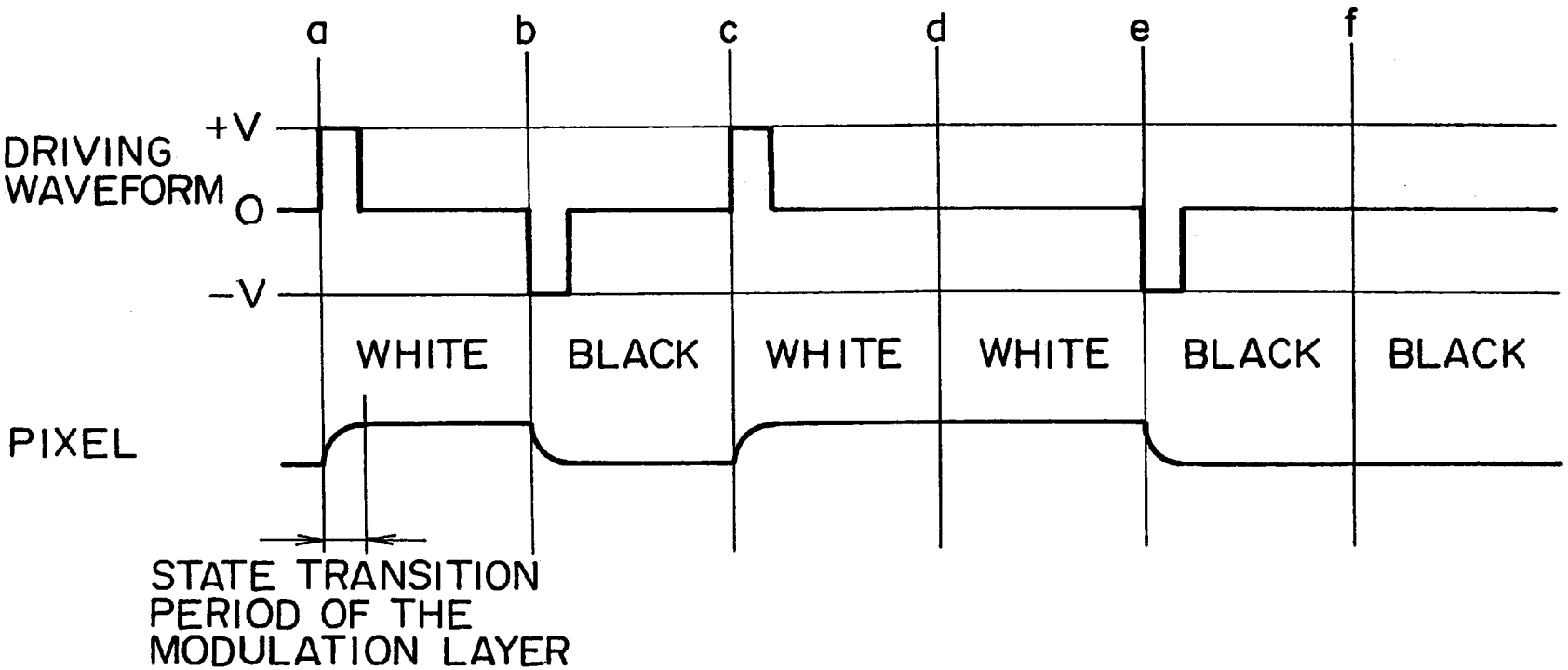
FIG. 21 is a diagram showing a typical waveform of a driving signal of a driver employed in the $4^{th}$ embodiment.
Figure 22:
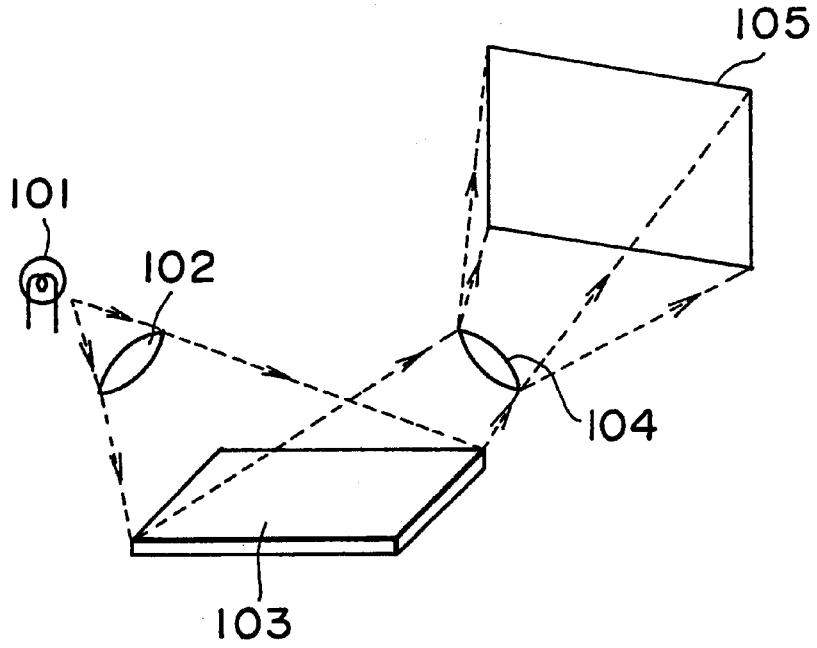
FIG. 22 is a conceptual diagram showing an image display apparatus.
Figure 23:
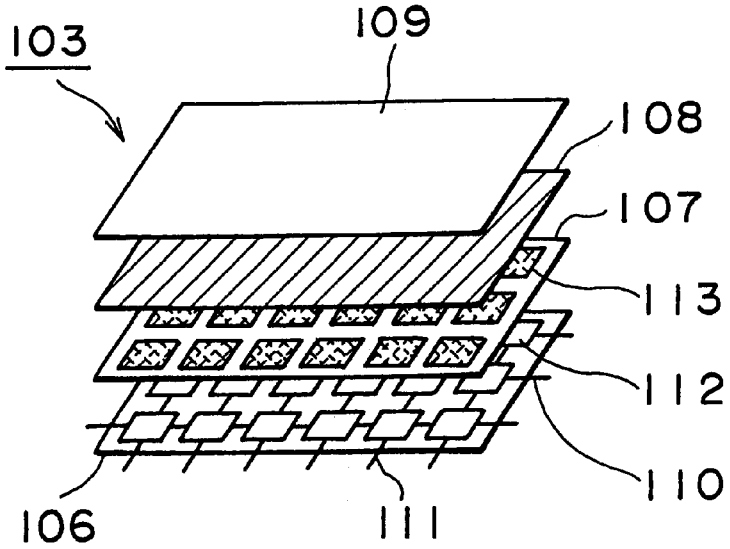
FIG. 23 is a diagram showing a squint view of disassembled components of an enlarged portion of an optical spatial modulation device.
Figure 24A:
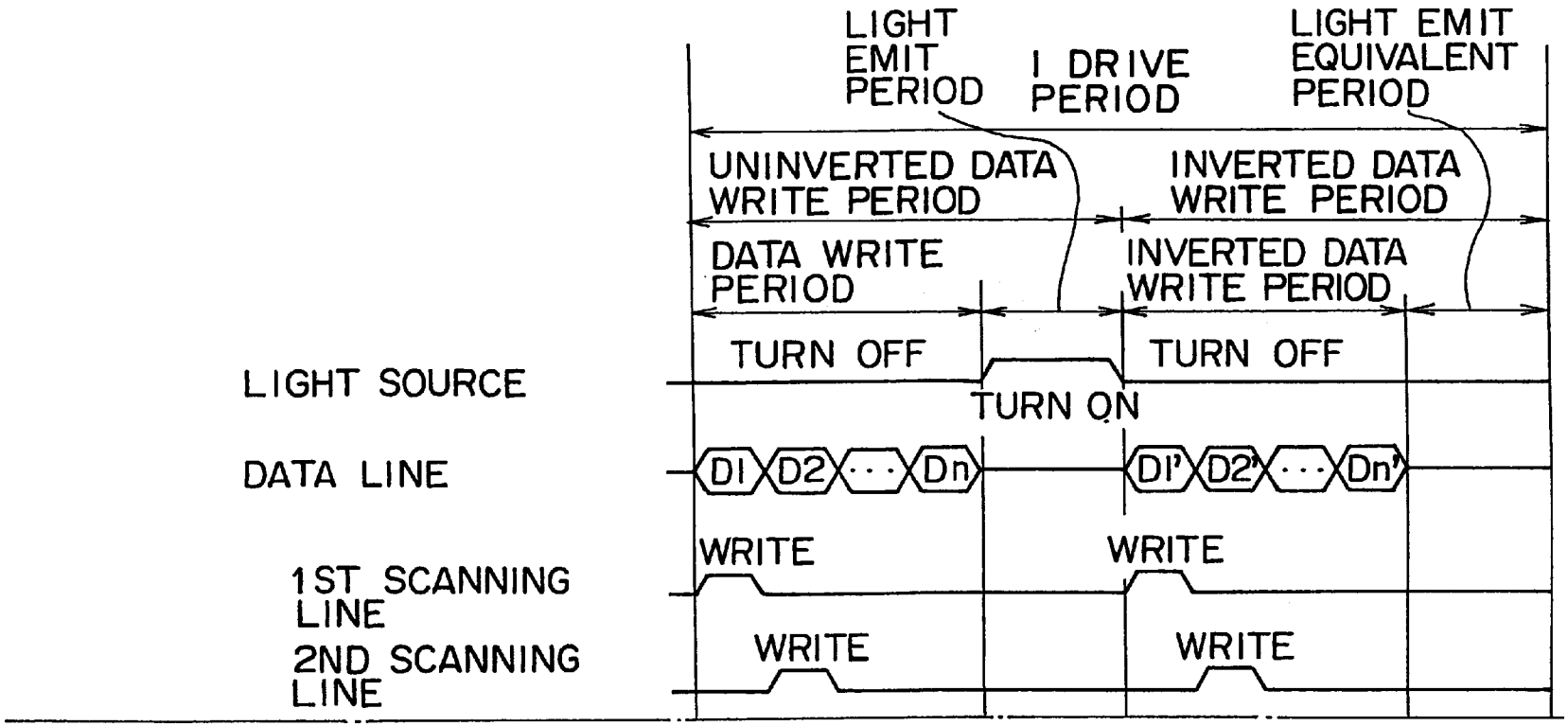
FIG. 24, consisting of FIGS. 24A through 24B, is driving timing charts of an image display apparatus adopting a 2-field technique.
Figures 24, 24B:
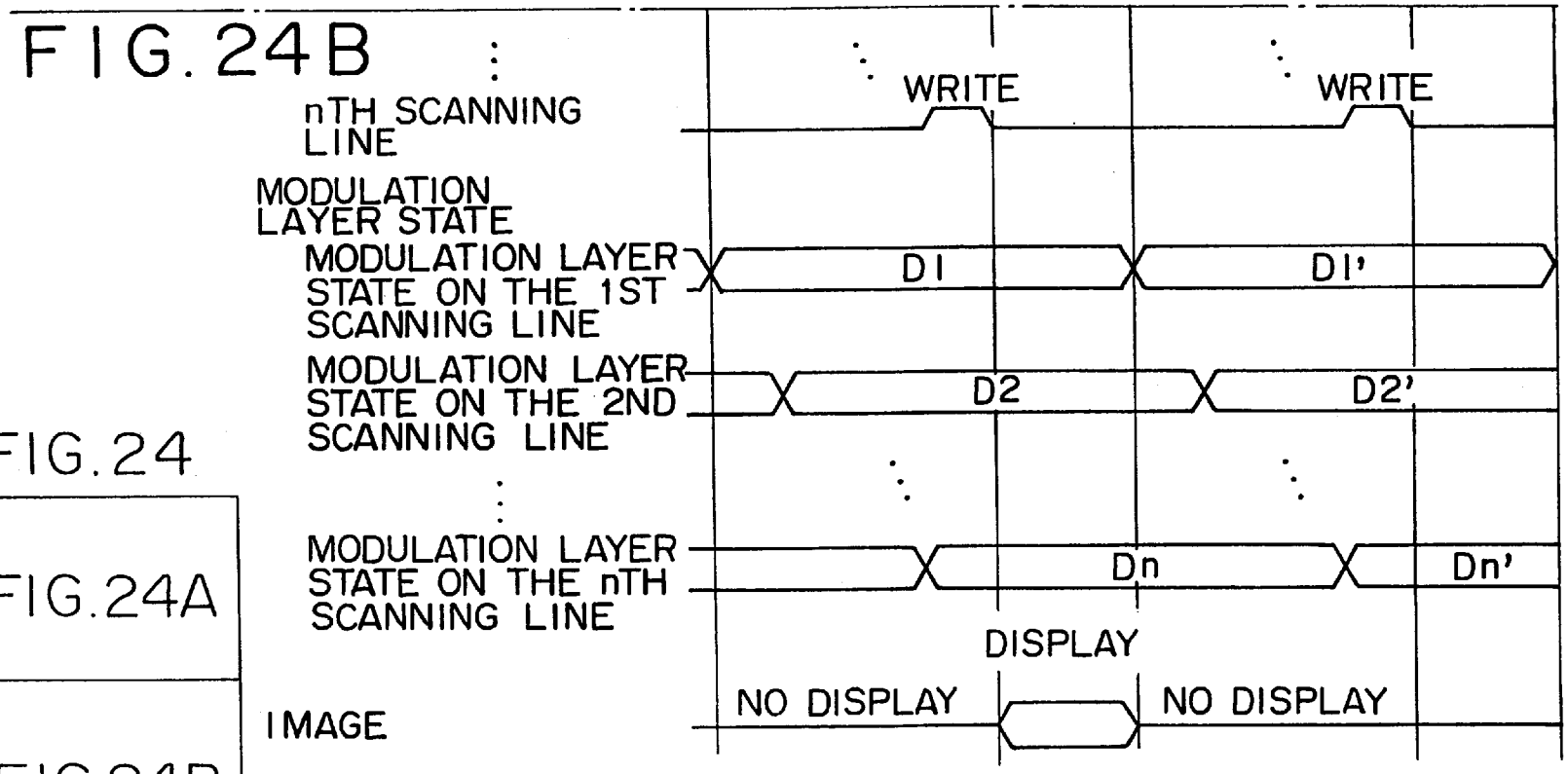

FIG. 21 is a diagram showing a typical waveform of a driving signal of the driver 58 for changing the color of a pixel in accordance with images to be displayed in the following order: white, black, white, white, black and black. The driver 58 is driven only in periods at points of time denoted by symbols a, b, c and e in FIG. 21 but not in periods at points of time denoted by symbols d and f. It is obvious from the figure that the driver 58 is driven only if the pixel data of an image prior to the operation to change the screen is different from pixel data of the replacing image. In other cases, the state of the pixel is sustained as it is.

In the case of the present embodiment, when changing a displayed image, only pixels involved in the change are rewritten as a batch as described above. As a result, the time required to rewrite the pixels can be reduced to a minimum and the light utilization rate of the optical spatial modulation device can be increased substantially. In addition, since only a required minimum number of pixels are rewritten, the number of transfers of electric charge accompanying the operation to rewrite the pixels can also be decreased to a minimum, allowing the amount of electric power required for driving the optical spatial modulation device to be reduced considerably.

It is obvious from the timing charts shown in FIG. 20 that the operation to store pixel data in the $1^{st}$ memory 51 is started at the beginning of the light emit period. It should be noted, however, that the operation to store pixel data in the $1^{st}$ memory 51 can also be carried out upon completion of the transfer of pixel data to the $2^{nd}$ memory 53. That is to say, the operation to store pixel data in the $1^{st}$ memory 51 can also be carried out during the transfer period. An operation to store pixel data in the $1^{st}$ memory 51 during a transfer period is effective when it is desired to shorten the time to display 1 image.

As has been described above in detail, since the optical spatial modulation device provided by the present invention includes a plurality of memories for each pixel, an image can be rewritten with a high degree of efficiency. That is to say, the response speed of the optical spatial modulation device provided by the present invention can be increased substantially.

In addition, since the image display apparatus provided by the present invention employs an optical spatial modulation device having a plurality of memories for each pixel, an image can be rewritten with a high degree of efficiency. That is to say, the response speed of the image display apparatus provided by the present invention can be increased substantially. In addition, since the light emit period can be lengthened, a very high intensity can be obtained.

What is claimed is:

1. A reflection type optical modulation device, said device comprising:

a common electrode a liquid crystal layer; and a reflection layer;

a silicon backplane drive layer, said silicon backplane drive layer comprising, for each of said pixels:

a $1^{st}$ memory for storing pixel data of an image to be displayed;

a $2^{nd}$ memory to which pixel data stored in said $1^{st}$ memory is transferred; and a driving means for driving said liquid crystal layer in accordance with pixel data transferred to said $2^{nd}$ memory, wherein an operation to display an image on said reflection type optical modulation device comprises the steps of:

storing pixel data in said $1^{st}$ memory corresponding to each of all pixels composing said image;

transferring said pixel data from said $1^{st}$ memory in which said pixel data has been stored to the corresponding $2^{nd}$ memory; and driving said liquid crystal layer on the basis of said pixel data by said driving means, to modulate the radiated light for each of said pixels by said liquid crystal layer, wherein in an operation to change a displayed image, only states of those pixels which need to be changed are changed by said driving means, wherein for each of said pixels, said optical modulation device comprises:

a judgment forming means for forming a judgment as to whether or not a state of each pixel of said displayed image is the same as a state of said pixel prior to said operation to change said displayed image; and a $3^{rd}$ memory for storing a result of said judgment formed by said judgment forming means.

2. A reflection type optical modulation device according to claim 1, wherein in an operation to change a displayed image, only states of pixels which need to be changed are changed by said driving means in accordance with said result of said judgment stored in said $3^{rd}$ memory.

3. A reflection type optical modulation device comprising:

a common electrode;

a modulation layer;

a reflection layer; and a driving layer having a plurality of memory cells, each of said plurality of memory cells having:

a $1^{st}$ memory for storing pixel data;

a $2^{nd}$ memory for storing said pixel data;

a $1^{st}$ gate for transferring said pixel data from said $1^{st}$ memory to said $2^{nd}$ memory; and a driver, wherein said pixel data contained within each said $1^{st}$ memory of said plurality of memory cells are simultaneously transferred to a corresponding $2^{nd}$ memory.

4. A reflection type optical modulation device according to claim 3, wherein pixel data to be next displayed is written in said $1^{st}$ memory in an image display period.

5. A reflection type optical modulation device according to claim 3, wherein said driver drives said modulation layer in accordance with said pixel data.

6. A reflection type optical modulation device according to claim 3, wherein said plurality of memory cells further comprises a $2^{nd}$ gate for transferring said pixel data from said $2^{nd}$ memory to said driver.

7. A reflection type optical modulation device according to claim 6, wherein said $2^{nd}$ gate transfers said pixel data to said driver as one of inverted pixel data and uninverted pixel data.

8. A reflection type optical modulation device according to claim 3, wherein said driver is controlled by a control line connected to said driver.

9. A reflection type optical modulation device according to claim 8, wherein said control line controls said driver to return said modulation layer to an initial state.

10. A reflection type optical modulation device according to claim 3, wherein said plurality of memory cells further comprises:

a match detection circuit for comparing said pixel data stored within said $1^{st}$ memory with said pixel data stored within said $2^{nd}$ memory to determine whether said pixel data stored within said $1^{st}$ memory matches said pixel data stored within said $2^{nd}$ memory;

a $3^{rd}$ memory for storing information indicating whether said pixel data stored within said $1^{st}$ memory matches said stored within said $2^{nd}$ memory;

a $2^{nd}$ gate for transferring said information from said match detection circuit to said $3^{rd}$ memory; and a $3^{rd}$ gate for transferring said pixel data from said $2^{nd}$ memory and said information from said $3^{rd}$ memory to said driver.

11. A method of forming an image using a reflection type optical modulation device, said device having a driving layer that includes a plurality of memory cells, each of said plurality of memory cells having a $1^{st}$ memory and a $2^{nd}$ memory, said method comprising:

storing pixel data within said $1^{st}$ memory; and simultaneously transferring said stored pixel data from each said $1^{st}$ memory to said $2^{nd}$ memory corresponding to said $1^{st}$ memory.

* * * * *